US007791581B2

(12) United States Patent
Maeda et al.

(10) Patent No.: US 7,791,581 B2
(45) Date of Patent: Sep. 7, 2010

(54) SHIFT REGISTER BLOCK, AND DATA SIGNAL LINE DRIVING CIRCUIT AND DISPLAY DEVICE USING THE SAME

(75) Inventors: Kazuhiro Maeda, Nara (JP); Hajime Washio, Sakurai (JP); Eiji Matsuda, Tenri (JP); Yuhichiroh Murakami, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 546 days.

(21) Appl. No.: 10/714,935

(22) Filed: Nov. 18, 2003

(65) Prior Publication Data

US 2004/0100436 A1 May 27, 2004

(30) Foreign Application Priority Data

Nov. 22, 2002 (JP) ..... 2002-340044

(51) Int. Cl.
*G09G 3/36* (2006.01)

(52) U.S. Cl. ..... 345/100; 345/76

(58) Field of Classification Search ..... 345/76–104; 377/64–81; *G09G 19/00, 19/28*
See application file for complete search history.

(56) References Cited

U.S. PATENT DOCUMENTS

| | | | | |
|---|---|---|---|---|
| 4,821,299 | A | 4/1989 | Kawai et al. | |
| 5,602,561 | A * | 2/1997 | Kawaguchi et al. | 345/99 |
| 5,889,504 | A | 3/1999 | Kihara et al. | |
| 6,072,456 | A * | 6/2000 | Karube et al. | 345/98 |
| 6,177,916 | B1 | 1/2001 | Aoki et al. | |
| 6,232,946 | B1 * | 5/2001 | Brownlow et al. | 345/98 |
| 6,507,332 | B1 | 1/2003 | Kuwabara et al. | |
| 6,702,407 | B2 * | 3/2004 | Azami | 305/204 |
| 6,724,361 | B1 * | 4/2004 | Washio et al. | 345/98 |
| 2001/0048408 | A1 | 12/2001 | Koyama et al. | |
| 2002/0000969 | A1 | 1/2002 | Ozawa | |
| 2003/0206608 | A1 | 11/2003 | Kawahata et al. | 377/64 |

FOREIGN PATENT DOCUMENTS

| | | | |
|---|---|---|---|
| JP | 63016500 | | 1/1988 |
| JP | 02312099 | A * | 12/1990 |
| JP | 5-303080 | | 11/1993 |
| JP | 6-82754 | | 3/1994 |
| JP | 8-212793 | | 8/1996 |
| JP | 10-307543 | | 11/1998 |
| JP | 10-340067 | | 12/1998 |
| JP | 2001135093 | A * | 5/2001 |
| JP | 2001-312243 | | 11/2001 |
| KR | 2002-0004810 | | 1/2002 |
| KR | 2002-0059218 | | 7/2002 |

* cited by examiner

*Primary Examiner*—Jimmy H Nguyen
(74) *Attorney, Agent, or Firm*—Nixon & Vanderhye, PC

(57) ABSTRACT

In a shift register block according to the present invention, a plurality of flip-flops F/F(1), F/F(2), . . . F/F(n) constitute a shift register SR, and each adjacent ones of these flip-flops are therebetween having a corresponding one of waveform processing circuits WR(1) through WR(n), so that the shift register SR and the waveform processing circuits WR(1) and WR(n) are linearly aligned. With such an arrangment, it is possible to reduce area occupied by a signal line driving circuit including the shift register block, thereby narrowing the frame area of a display device.

13 Claims, 20 Drawing Sheets

SHIFT REGISTER BLOCK, AND DATA SIGNAL LINE DRIVING CIRCUIT AND DISPLAY DEVICE USING THE SAME

This Nonprovisional application claims priority under 35 U.S.C. §119(a) of Patent Application No. 2002/340044 filed in Japan on Nov. 22, 2002, the entire contents of which are hereby incorporated by reference.

FIELD OF THE INVENTION

The present invention relates to a shift register block suitable for a display device driven by an active-matrix manner, and relates to a data signal line driving circuit and a display device using the shift register block.

BACKGROUND OF THE INVENTION

In recent years, an active-matrix-type image display device (display device) including a thin film transistor (TFT) has come to the fore as a display device ensuring high picture quality.

The following will explain an active-matrix-type image display device with reference to FIG. 20.

As shown in FIG. 20, an active-matrix-type display device includes a pixel array 102 a plurality of pixels 108 aligned in a matrix manner, a data signal line driving circuit 103 for driving data signal lines s1 of the pixel array 102, a scanning signal line driving circuit 104 for driving scanning signal lines g1 of the pixel array 102, a power source circuit 105 for supplying power to the respective driving circuits 103 and 104, and a control circuit 106 for supplying a control signal to the respective driving circuits 103 and 104.

In addition to the plurality of pixels 108, the pixel array 102 includes a plurality of data signal lines s1 and a plurality of scanning signal lines g1, which intersect the data signal lines s1, respectively. The pixel 108 is provided for each pair of the respective data signal lines s1 and the respective scanning signal lines g1.

The control circuit 106 outputs an image signal dat indicating an image to be displayed in the pixel array 102. The image signal dat is constituted of image data showing display condition for the respective pixels 108 in the target image and transmitted in a time divisional manner. The control circuit 106 outputs a clock signal sck and a start pulse signal ssp to the data signal line driving circuit 103 as timing signals with the image signal dat, so as to allow the image signal dat to be appropriately displayed in the pixel array 102, and also outputs the clock signal gck and the start pulse signal gsp to the scanning signal line driving circuit 104.

The scanning signal line driving circuit 104 sequentially selects the plurality of scanning signal lines g1 in synchronism with a timing signal, such as the clock signal gck. Further, the data signal line driving circuit 103 operates in synchronism with a timing signal, such as the clock signal sck, and specifies appropriate timings to be corresponding to the respective data signal lines s1. Further, the data signal line driving circuit 103 samples the image signal dat at the specified timings, and write the resulting signals to the respective data signal lines s1 as a result of sampling.

Meanwhile, while the corresponding scanning signal line g1 is selected, the respective pixels 108 control brightness corresponding to the data outputted to the corresponding data signal line s1. Consequently, the pixel array 102 displays an image indicated by the image signal dat.

Next, the following will explain a circuit structure of the data signal line driving circuit. The structure of the data signal line driving circuit differs depending on whether the image signal dat is an analog signal or a digital signal; however, its common structure is made up of a shift register and a plurality of waveform processing circuits (processing circuit) for processing selection signals which are sequentially supplied from the respective stages of the shift register.

The shift register is constituted of a plurality of flip-flops (unit circuit), which are sequentially connected in a form of cascade connection, so as to output a supplied pulse according to a separately supplied clock signal. Each of the flip-flops is provided as an output stage of the shift register. When a start pulse signal (input signal) is supplied to the shift register, the start pulse signal is sequentially outputted starting from the first flip-flop of the input side, through the respective stages of the flip-flops at the same timing as the clock signal.

FIG. 17 shows a conventional layout of a data signal line driving circuit including one system shift register sr.

As shown in the figure, the flip-flops F/F are individually provided for each alignment of the data signal lines s1. In this structure, the flip-flops F/F (1), F/F (2), . . . F/F (n) are linearly disposed and sequentially connected in a form of cascade connection, corresponding to the n data signal lines s1. More specifically, the respective flip-flops F/F are simultaneously supplied with the clock signal (control signal) sck, and the input terminal IN of the first-stage flip-flop F/F (1) is supplied with the start pulse (control signal) ssp, and output of the output terminal OUT of the flip-flop F/F (1) is supplied to the input terminal IN of the next-stage flip-flop F/F (2) and the input terminal IN of the waveform processing circuit WR (1). Likewise, output of the output terminal OUT of the flip-flop F/F (2) is supplied to the input terminal IN of the next-stage flip-flop F/F (3) and the input terminal IN of the waveform processing circuit WR (2). In the same manner, the signal is supplied to the remaining flip-flops and the waveform processing circuits.

The plurality of waveform processing circuits WR (1), WR (2), . . . WR (n), which are supplied with output signals of the respective flip-flops F/F of the shift register, are provided along the data signal line s1 of the corresponding flip-flop, in other words, in a portion closer to the starting side of the data signal line s1.

Each flip-flop F/F and the corresponding waveform processing circuit WR constitute a circuit block for driving one data signal line s1. Note that, in the present specification, the horizontal direction refers to the alignment direction of the data signal lines s1, i.e., the direction along the scanning signal line g1, and the vertical direction refers to the orthogonal direction, i.e., the direction along the data signal line s1.

Some of the data signal line driving circuit include a plurality of shift registers, each of which has a less number of output stages, i.e., a less number of flip-flops F/F. In the present specification, a shift register block refers to a group of shift registers including a required number of output stages regardless of the number of systems of shift register.

The shift register in multiple-systems is aimed at reduction of driving frequency of the driving circuit. For example, a two-system shift register can reduce the driving frequency to ½.

FIG. 18 shows a conventional layout of the data signal line driving circuit made up of a two-system shift register. As shown in the figure, the first system shift register sr1 is made up of a flip-flop F/F1(1), F/F1(2), . . . F/F1(m), and supplied with the clock signal sck1 and the start pulse ssp1 as control signals; and the second system shift register sr1 is made up of a flip-flop F/F2(1), F/F2(2), . . . F/F2(m), and supplied with the clock signal sck2 and the start pulse ssp2 as control signals. The first and second systems are provided to be in parallel with each other in the vertical direction.

Further, a plurality of waveform processing circuit WR1(1) through WR1(m), which are respectively supplier with outputs of the flip-flops F/F1(1) through F/F1(m) constituting the first system shift register sr1, are provided between the first system shift register sr1 and the second system shift register sr2. Likewise, a plurality of waveform processing circuit WR2(1) through WR2(m), which are respectively supplied with outputs of the flip-flops F/F2(1) through F/F2(m) constituting the second system shift register sr2, are provided in parallel with the second system shift register sr2.

Further, apart from reduction of driving frequency, such a data signal line driving circuit including multiple-systems of shift register is aimed at provision of a redundant shift register in addition to the regular shift registers, as a redundant circuit to be used in case of defect (For example, refer to the specification of U.S. Pat. No. 5,889,504 (Japanese Laid-Open Patent Application Tokukaihei 08-212793/1996 (published on Aug. 20, 1996))).

Further, some of conventional active-matrix-type display devices adopt a driving method in which an image signal is divided to be separate image signals, which are simultaneously sampled when the signals are supplied to a plurality of image signal lines (For example, refer to Japanese Laid-Open Patent Application Tokukaihei 11-24632/1999 (published on Jan. 29, 1999)).

With reference to FIG. 19, the following will explain this driving method, which is commonly known as a multiple-system operation. As shown in the figure, the image signal dat is not divided in an arrangement not using the multiple-system operation, and therefore only one circuit block is required for the pixels of Red (R), Green (G) and Blue (B), since these three color pixels are simultaneously driven as one group by output of the one circuit block, which is constituted of a flip-flop F/F and a waveform processing circuit WR.

On the other hand, in the two-system operation in which the image signal dat is divided into two pieces, the number of image signal lines doubles compared with the arrangement which does not use the multiple-system operation. However, the two data signal lines SL, each of which drives two groups of R, G and B pixels, are driven by the same timing. Therefore, in this two-system operation, only one circuit block is required for two groups of pixels.

Accordingly, in a four-system operation, four data signal lines SL individually drive four groups of R, G and B pixels at the same timing using only one circuit block. Likewise, an eight-system operation requires one circuit block for eight groups of pixels.

By thus performing such a multiple-system operation, the number of image signal lines increases so as to carry the divided signal; however, the increased number of data signal lines can be driven as one group by only one circuit block. Thus, the area occupied by one circuit block, which is an area extended in the horizontal direction and restricted by the pixel pitch, can be widened, and the sampling frequency can be reduced.

As has been described, a data signal line driving circuit using such a multiple-system operation, in which the image signal is divided, is becoming more common. The simultaneous operation in which a plurality of data signal lines SL are driven at the same time offers a wider area for the circuit block in the horizontal direction. As can be seen in FIG. 19, the area becomes respectively twice, four times, and eight times as large as the arrangement not using the multiple-system operation, in a two-system operation, in a four-system operation, and in an eight-system operation.

However, in such a conventional data signal line driving circuit, the respective waveform processing circuits WR are positioned closer to the output side (refer to FIG. 17) of the shift register sr, i.e., the waveform processing circuits WR are extended in the vertical direction. With this structure, the area widened in the horizontal direction due to multiple-system operation is effectively not used.

Further, in the multiple-systems of shift register of FIG. 18 with the shift registers sr1 and sr2 adjacently disposed in the vertical direction, the respective systems have different distances from the data signal lines SL. This causes variation of delay time of the output of the shift register, thus degrading display quality.

Such variation of delay time can be solved by processing the clock signal sck etc. supplied to the shift registers sr1 and sr2. However, the processing induces unwanted increase of circuit scale, since the processing of signal requires more complicated circuit structure.

SUMMARY OF THE INVENTION

The present invention is made in view of the foregoing conventional problems, and an object is to provide a shift register block which can realize a narrower frame of a display device, and a signal line driving circuit and a data signal line driving circuit including such a shift register, so as to provide a display device with a narrower frame.

Another object of the present invention is to provide multiple systems of shift register including a shift register block, which can solve variation of delay time of output of the shift register between the respective systems without complicating circuit structure, and a signal line driving circuit and a data signal line driving circuit including such a shift register block, so as to provide a display device with a narrower frame and high display quality.

In order to solve the foregoing problems, the shift register block according to the present invention comprises: at least one system of a shift register constituted of a plurality of unit circuits in a form of cascade connection and outputting an input signal in response to a clock signal, the shift register sequentially outputting a selection signal from output-stages constituted of the unit circuits, wherein: the plurality of unit circuits are disposed with a unit circuit of a preceding output stage and a unit circuit of a following output stage being separated by a circuit different from the unit circuits.

In the foregoing arrangement, the shift register block is arranged so that each of adjacent unit circuits in a form of cascade connection for constituting a system of shift registers have therebetween different circuits not involved in operation of the shift register. Adoption of such a layout of the shift register block in which the different circuits are distributed between the respective unit circuits allows further reduction of the required layout area in the vertical direction, compared to the conventional arrangement of a shift register block in which the different circuits are provided in parallel with the alignment of the shift register in the vertical direction.

Particularly, in this structure, the unit circuits of different systems are linearly disposed by placing unit circuits of one system between unit circuits of the other system. Accordingly, in contrast to the case where the shift registers of different systems are disposed in parallel with each other in the vertical direction, it is possible to prevent variation of delay time of output signals between the shift registers of different systems due to difference of distance for supplying output signals.

Further, the foregoing different circuit may be a processing circuit which uses output of one of the unit circuits constituting the shift register, a unit circuit constituting a shift register of a different system, and a processing circuit which uses output of one of the unit circuits constituting the shift register of the different system.

In this arrangement, the shift registers of different systems are linearly disposed, and besides, the processing circuits using outputs of the respective unit circuits constituting the shift register of different systems are further linearly disposed between the respective shift registers of different systems. Adoption of such a layout of the shift register block allows further reduction of the required layout area in the vertical direction, while also preventing variation of delay time of output signals between the shift registers of different systems.

In order to solve the foregoing problems, a signal line driving circuit according to the present invention comprises: a shift register block for sequentially outputting a selection signal, so as to drive a plurality of signal lines, wherein: the shift register block comprises: at least one system of a shift register constituted of a plurality of unit circuits in a form of cascade connection and outputting an input signal in response to a clock signal, the shift register sequentially outputting a selection signal from output-stages constituted of the unit circuits, the plurality of unit circuits being disposed with a unit circuit of a preceding output stage and a unit circuit of a following output stage being separated by a circuit different from the unit circuits.

As explained above, the shift register block according to the present invention allows effective reduction of the required layout area in the vertical direction, while also preventing variation of delay time of output signals between the shift registers of different systems when including plural systems of shift registers.

Accordingly, by using a signal line driving circuit including such a shift register block for a scanning signal line driving circuit and/or a data signal line driving circuit of a display device, it is possible to effectively reduce the frame area around the display section, while ensuring display quality.

In order to solve the foregoing problems, a data signal line driving circuit according to the present invention comprises a sampling section for driving a plurality of data signal lines by sampling image data from an image signal according to a selection signal sequentially outputted from a shift register-block so as to transfer the image data to the data signal lines, wherein: the shift register block comprises: at least one system of a shift register constituted of a plurality of unit circuits in a form of cascade connection and outputting an input signal in response to a clock signal, the shift register sequentially outputting a selection signal from output-stages constituted of the unit circuits, the plurality of unit circuits being disposed with a unit circuit of a preceding output stage and a unit circuit of a following output stage being separated by a circuit different from the unit circuits.

As explained above, the shift register block according to the present invention allows effective reduction of the required layout area in the vertical direction, while also preventing variation of delay time of output signals between the shift registers of different systems when including plural systems of shift registers.

Accordingly, by mounting a data signal line driving circuit including such a shift register block, it is possible to effectively reduce the frame area around the display section, while ensuring display quality.

As described, a display device according to the present invention comprises: a plurality of data signal lines; a plurality of scanning signal lines intersecting with the data signal lines; pixels provided for each pair of the data signal lines and the scanning signal lines; a scanning signal line driving circuit for driving the scanning signal lines; and a data signal line driving circuit comprising a sampling section for driving a plurality of data signal lines by sampling image data from an image signal according to a selection signal sequentially outputted from a shift register block so as to transfer the image data to the data signal lines, wherein: the shift register block of the data signal line driving circuit comprises: at least one system of a shift register constituted of a plurality of unit circuits in a form of cascade connection and outputting an input signal in response to a clock signal, the shift register sequentially outputting a selection signal from output-stages constituted of the unit circuits, the plurality of unit circuits being disposed with a unit circuit of a preceding output stage and a unit circuit of a following output stage being separated by a circuit different from the unit circuits.

As explained above, the shift register block according to the present invention allows effective reduction of the required layout area in the vertical direction, while also preventing variation of delay time of output signals between the shift registers of different systems when including plural systems of shift registers.

Accordingly, by mounting a data signal line driving circuit including such a shift register block in a display device, it is possible to effectively reduce the frame area around the display section, while ensuring display quality.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 4(*b*) illustrates an arrangement of monochrome display using an analog image signal, and using n-system operation.

FIG. 5(*b*) illustrates an arrangement of color display using an analog image signal, and using n-system operation.

FIG. 6(*b*) is a circuit diagram illustrating an arrangement example of a data latch circuit element constituting a data latch circuit of the waveform processing circuit of FIG. 6(*a*).

DESCRIPTION OF THE EMBODIMENTS

One embodiment of the present invention will be described below with reference to FIGS. 1 through 16.

Figure 2:
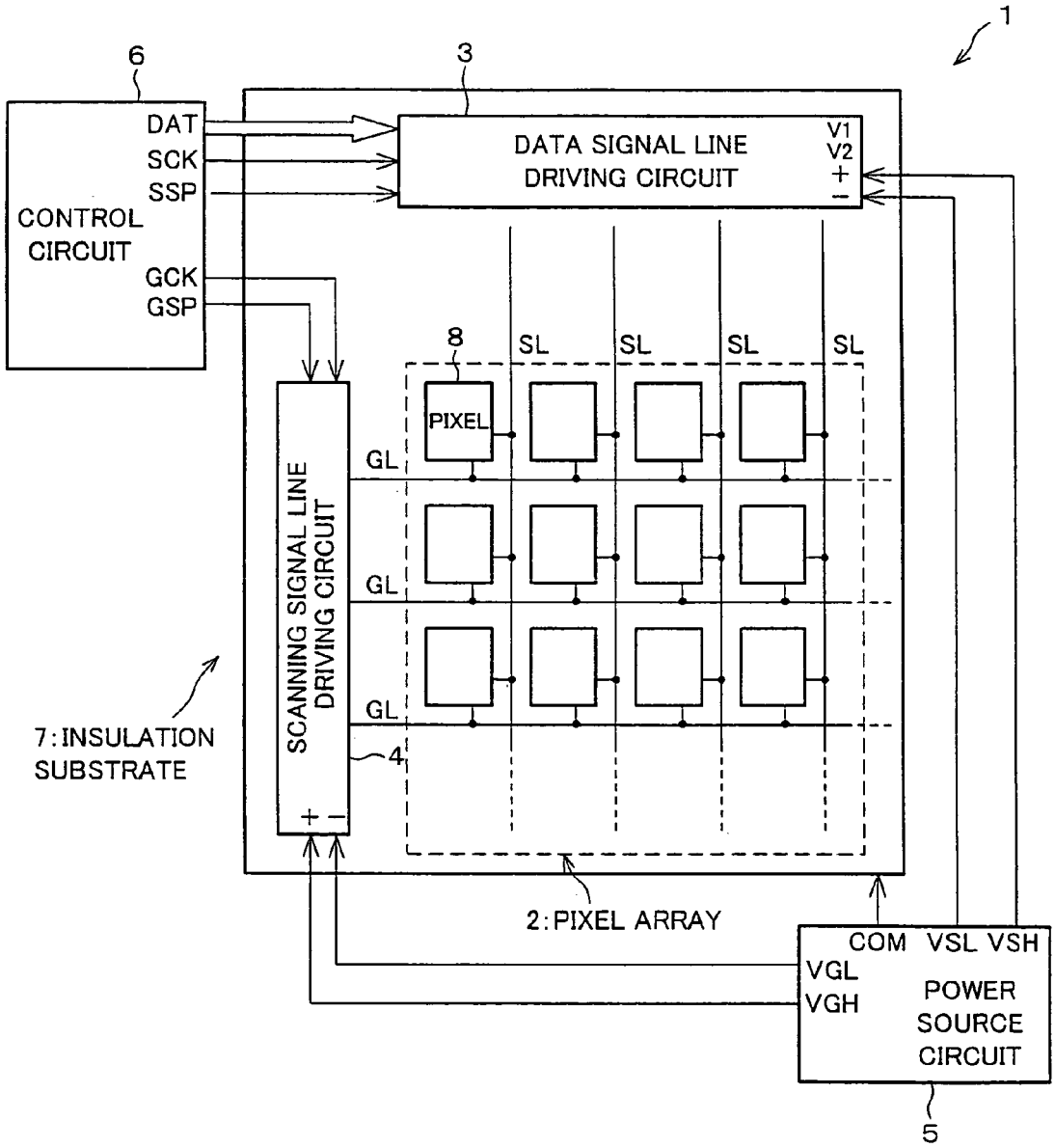
FIG. 2 is a block diagram illustrating an arrangement of a main part of an image display device including the foregoing data signal line driving circuit.

Firstly, the following will explain a common image display device (display device) which is used throughout the present embodiment. As shown in FIG. 2, an image display device 1, as the common image display device, includes a pixel array 2 in which a plurality of pixels 8 are aligned in a matrix manner, a data signal line driving circuit 3 for driving a plurality of data signal lines SL of the pixel array 2, a scanning signal line driving circuit 4 for driving a plurality of scanning signal lines SL of the pixel array 2, a power source circuit 5 for supplying power to those driving circuits 3 and 4, and a control circuit 6 for supplying control signals to those driving circuits 3 and 4. Among these members, the data signal line driving circuit 3 and the scanning signal line driving circuit 4 are formed on an insulation substrate 7 on which the pixel array 2 is formed.

The pixel array 2 includes a plurality of data signal lines SL, and a plurality of scanning signal lines GL, which intersect with each other. Further, the pixel 8 is formed on each pair of the data signal line SL and the scanning signal line GL. In the image display device 1 according to the present invention, the pixel 8 is provided between two adjacent data signal lines SL, and two adjacent scanning signal lines GL.

Figure 3:
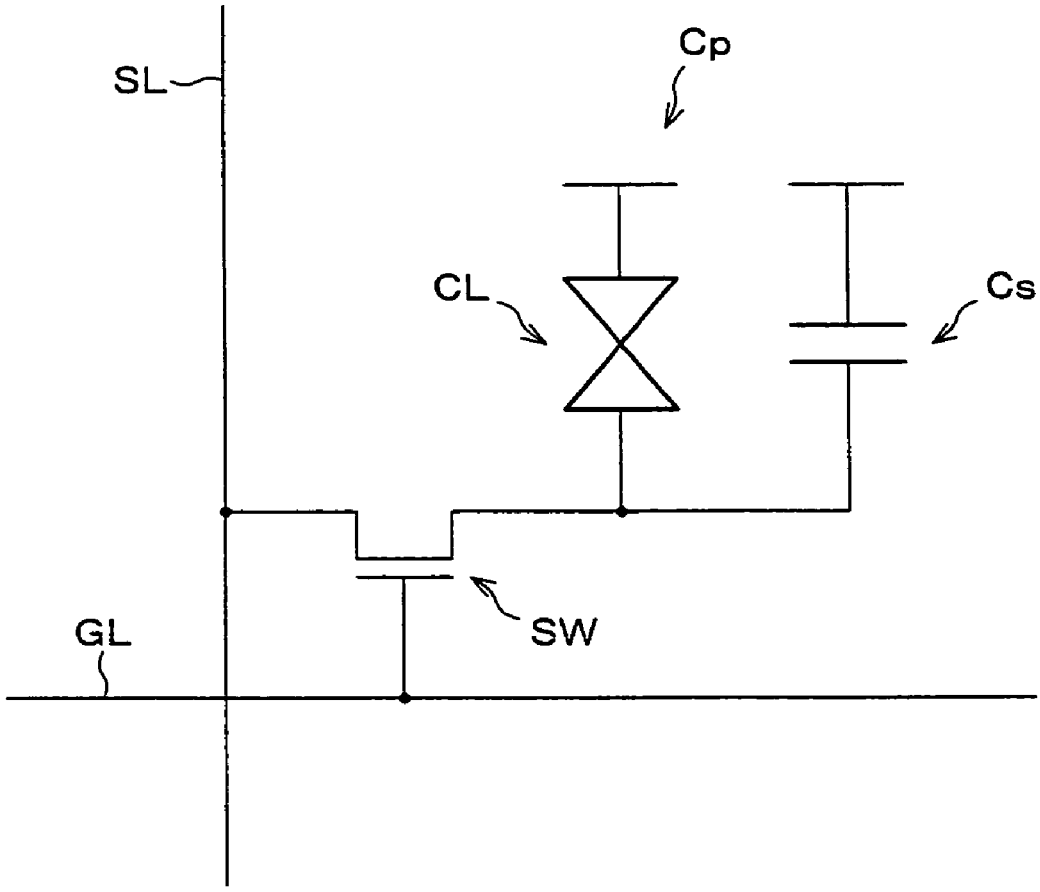
FIG. 3 is a circuit diagram illustrating a schematic arrangement of pixels in the foregoing image display device.

The following will explain one example of the pixel 8 assuming that the image display device 1 is a liquid crystal display device. In this case, as shown in FIG. 3, the pixel 8 includes a field effect transistor SW as a switching element, in which a gate electrode is connected to the scanning signal line SL and a drain electrode is connected to the data signal line GL, and a pixel capacitor Cp in which one of the electrodes is connected to the field effect transistor SW. Further, the other end of the pixel capacitor Cp is connected to a common electrode line for all of the pixels 8. The pixel capacitor Cp is made of a liquid crystal capacitor CL, and may include an auxiliary capacitor Cs as required.

When the scanning signal line GL is selected in the pixel 8, the field effect transistor SW is electrically conducted, and a voltage supplied to the data signal line SL is supplied to the pixel capacitor Cp. When the selecting period of the scanning line GL is terminated, the pixel capacitor Cp keeps the voltage at the time when the field effect transistor SW shuts down, during the period in which the TFT 1 is shut down. Here, transmittance and reflectance of the liquid crystal varies depending on a voltage supplied to the liquid crystal capacitor CL. Thus, when the scanning line GL is selected, and a voltage corresponding to the image data D for the pixel 8 is supplied to the data signal line SL, the display state of the pixel 8 is changed according to the image data D.

Note that, though the foregoing examples adopt liquid crystal, those configurations may also be adopted for other types of pixels in different arrangement, provided that the arrangement is capable of adjustment of brightness of the pixel 8 according to the value of the signal applied to the data line SL while a signal, showing the line is currently selected, is applied to the scanning line GL. Thus, any arrangements with the foregoing condition may also be adopted regardless of whether or not a display of a self-luminous.

The control circuit 6 outputs an image signal DAT, which indicates an image supposed to be displayed in the pixel array 2. Here, to function as the image signal DAT, the foregoing image data D showing display condition for each pixel 8 is transmitted in a time divisional manner.

The control circuit 6 outputs, in addition to the image signal DAT, a clock signal SCK and a start pulse signal GSP to the data signal line driving circuit 3, and outputs a clock signal GCK and a start pulse GSP to the scanning signal line driving circuit 4, as timing signals for appropriately showing the image signal DAT in the pixel array 2.

The scanning line driving circuit 4 outputs a signal, such as a voltage signal, to each of the scanning lines GL so as to indicate whether or not the line is currently selected (if the line is in a selection time). Further, the scanning line driving circuit 4 sequentially selects a different scanning line GL for outputting the foregoing signal indicating the selection time, according to a timing signal such as the clock signal GCK or the start pulse GSP supplied from the control circuit 6. With this operation, the scanning lines GL are sequentially selected by predetermined timings.

Further, the data signal line driving circuit 3 extracts respective image data D, which are inputted to the pixels 8 as the image signal DAT in the time divisional manner, by carrying out sampling of the image data D at a predetermined timing. Further, the data line driving circuit 3 outputs via the respective data lines SL output signals, which respectively correspond to the image data D, to the pixel 8 corresponding to the scanning line GL currently selected by the scanning line driving circuit 4.

Further, the data signal line driving circuit 3 in this example may have a function for performing multiple-phase driving with respect to the image signal DAT. In this case, the control circuit 6 divides the image signal DAT, which has been externally supplied, by a predetermined number, and then supplies the divided signal to the data signal line driving circuit 3 as divided image signals. The data signal line driving circuit 3 samples the divided image signal according to the number by which the image signal DAT is divided; more specifically, when the signal is divided by two for example, the data signal line driving circuit 3 simultaneously samples two streams of image signal respectively transmitted to two image signal lines. Further, in case of a color image display device, each color has two image signal lines, and therefore, the image display device simultaneously samples image data of the divided image signal transmitted to the two signal lines for each color.

Meanwhile, the pixel 8 determines its own brightness by adjusting the transmittance or luminance according to the respective output signals supplied to the corresponding data line while the corresponding scanning signal line is selected. As described above, the scanning signal line driving circuit 4 sequentially selects the respective scanning signal lines, so that all of the pixels 8 of the pixel array 2 can be adjusted to have the brightness denoted by the corresponding image data, thereby renewing the image display in the pixel array 2.

The following will minutely explain a layout for the data signal line driving circuit 3.

Figure 1:
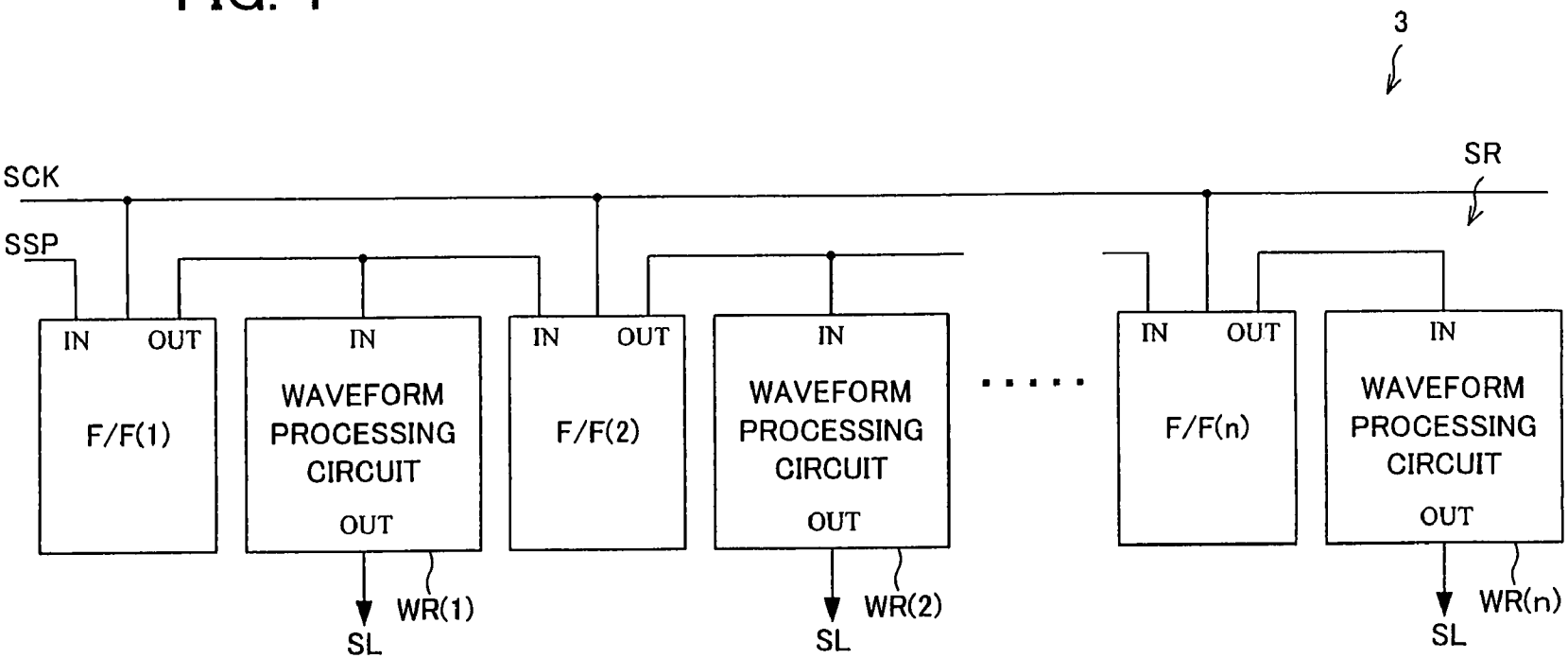
FIG. 1 is a block diagram illustrating a layout of a main part of a data signal line driving circuit according to one embodiment of the present invention.

FIG. 1 shows a layout of the data signal line driving circuit 3 including a one-system shift register.

The data signal line driving circuit 3 is constituted of a shift register, and a plurality of waveform processing circuits WR (1), WR (2), . . . WR (n) which respectively output the output signals of respective output stages of the shift register SR.

The shift register SR is constituted of a plurality of flip-flops F/F (1), F/F (2), . . . F/F (n), which are connected in a form of cascade connection as unit circuits for outputting the output signals of the shift register SR, each of the flip-flops constituting an output-stage of the shift register SR.

These flip-flops are all supplied with a clock signal SCK. The input terminal IN of the first-stage flip-flop F/F (1) is supplied with a start pulse signal SSP, and then, the output terminal OUT of the flip-flop F/F (1) outputs an output signal, which is then inputted to the input terminal IN of the second-stage flip-flop F/F (2) and the input terminal IN of the waveform processing circuit WR (1). Further, an output of the output terminal OUT of the flip-flop F/F (2) is inputted to the input terminal IN of the third-stage flip-flop F/F (3) and the input terminal IN of the waveform processing circuit WR (2). In this manner, the signal is propagated through the remaining flip-flops.

In this arrangement, when a start pulse signal (input signal) SSP is supplied to the shift register SR, the start pulse signal SSP is sequentially outputted from the flip-flop F/F (1), which is the first-stage flip-flop of the input side, to be sequentially propagated through the respective flip-flops, by the same timing as that of the clock signal SCK. With such a structure, there realizes a circuit block for driving one or one set (for each color) of data signal lines SL by using one flip-flop F/F and one waveform processing circuit WR.

One notable feature of the foregoing circuit block is positioning of the plurality of waveform processing circuits WR (1) through WR (n) which are respectively supplied with output signals of the plurality of flip-flops of the shift register SR. As shown in FIG. 1, the wave form processing circuits WR (1) through WR (n) are respectively provided between each adjacent pair of the plurality of flip-flops F/F (1) through F/F (n) which are connected in a form of cascade connection for constituting the shift register SR.

More specifically, the waveform processing circuit WR (1) supplied with an output of the first-stage flip-flop F/F (1) is provided between the first-stage flip-flop F/F (1) and the second-stage flip-flop F/F (2). Likewise, the waveform processing circuit WR (2) supplied with an output of the second-stage flip-flop F/F (2) is provided between the second-stage flip-flop F/F (2) and the third-stage flip-flop F/F (3) (not shown). In this manner, the remaining waveform processing circuits WR are respectively provided between corresponding pair of adjacent flip-flops F/F.

Figure 17:
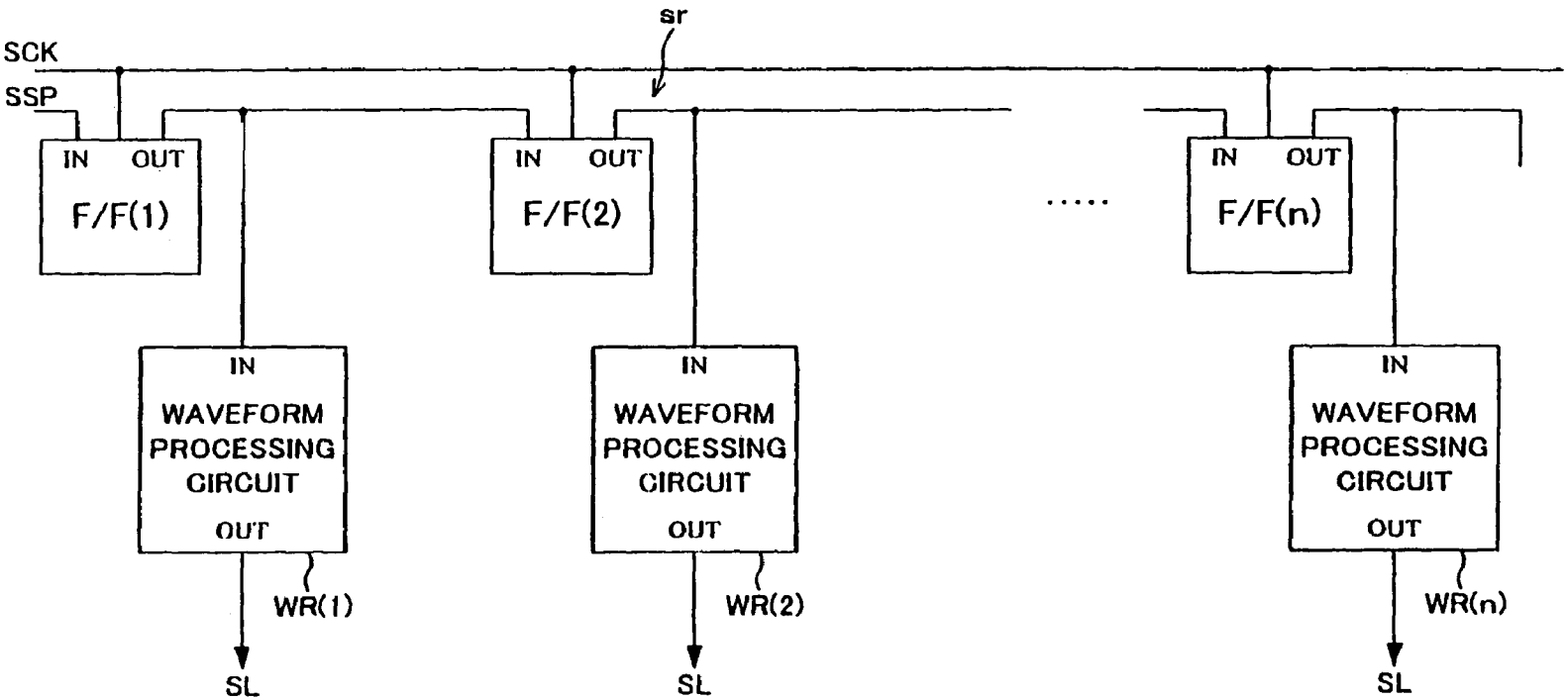
FIG. 17 Conventional Art
FIG. 17 is a block diagram illustrating a layout of a main part of a conventional data signal line driving circuit.

With such a layout, the shift register SR and the block of the waveform processing circuits WR (1) through WR (n) are aligned in a row. Therefore, the area of the shift register SR is reduced in the vertical direction (the direction to which the shift register outputs a signal), compared to the conventional structure shown in FIG. 17 in which the waveform processing circuits WR are provided in a different row from that having the shift register sr, and positioned in parallel with the shift register in the vertical direction. Consequently, it is possible to reduce frame area around the pixel array 2 of the image display device.

Figure 4:
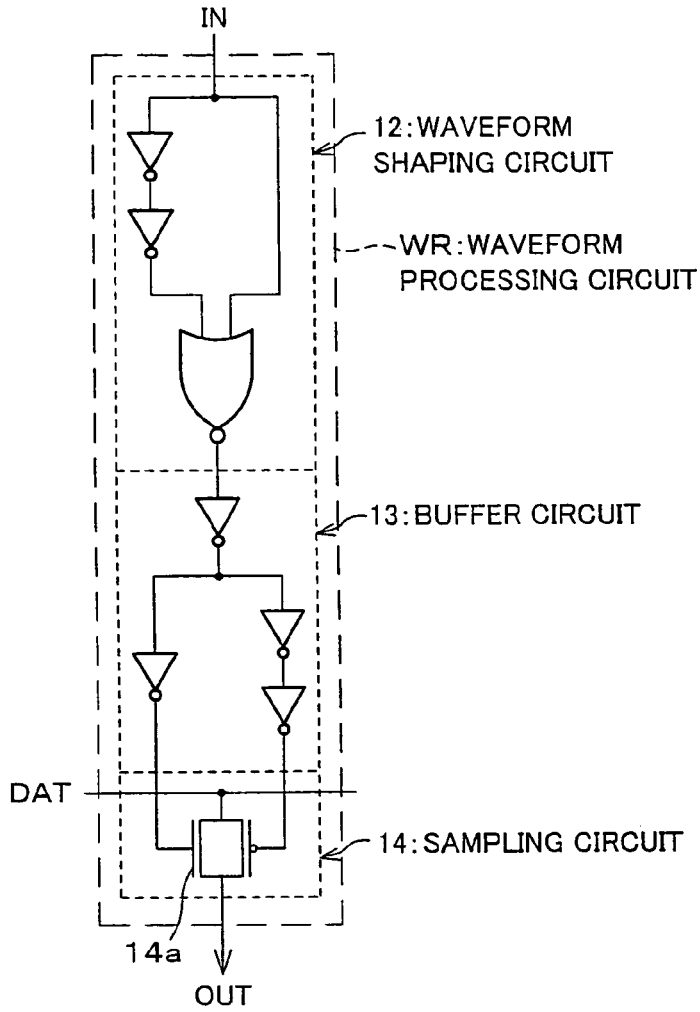
FIGS. 4(*a*) and 4(*b*) are circuit diagrams, each illustrate an arrangement example of a waveform processing circuit used for the foregoing data signal line driving circuit. More specifically, FIG. 4(*a*) illustrates an arrangement of monochrome display using an analog image signal, and not using multiple-system operation.
Figure 4:
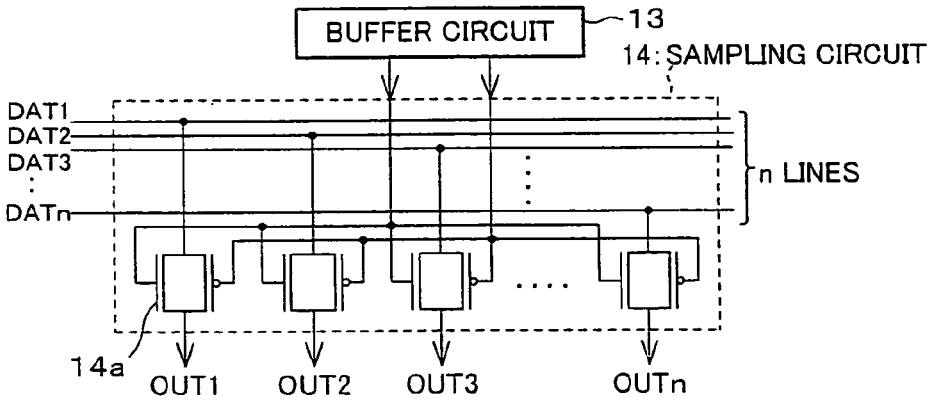

When the image signal DAT is an analog signal, the waveform processing circuit WR may be constituted of, as shown in FIGS. 4(*a*) and 4(*b*) or 5(*a*) and 5(*b*), a waveform shaping circuit 12, a buffer circuit 13, and a sampling circuit 14, for example. Those structures shown in FIGS. 4(*a*) and 4(*b*) are both used for monochrome display, which are respectively for one-phase driving, and for an n-phase driving.

Figure 5:
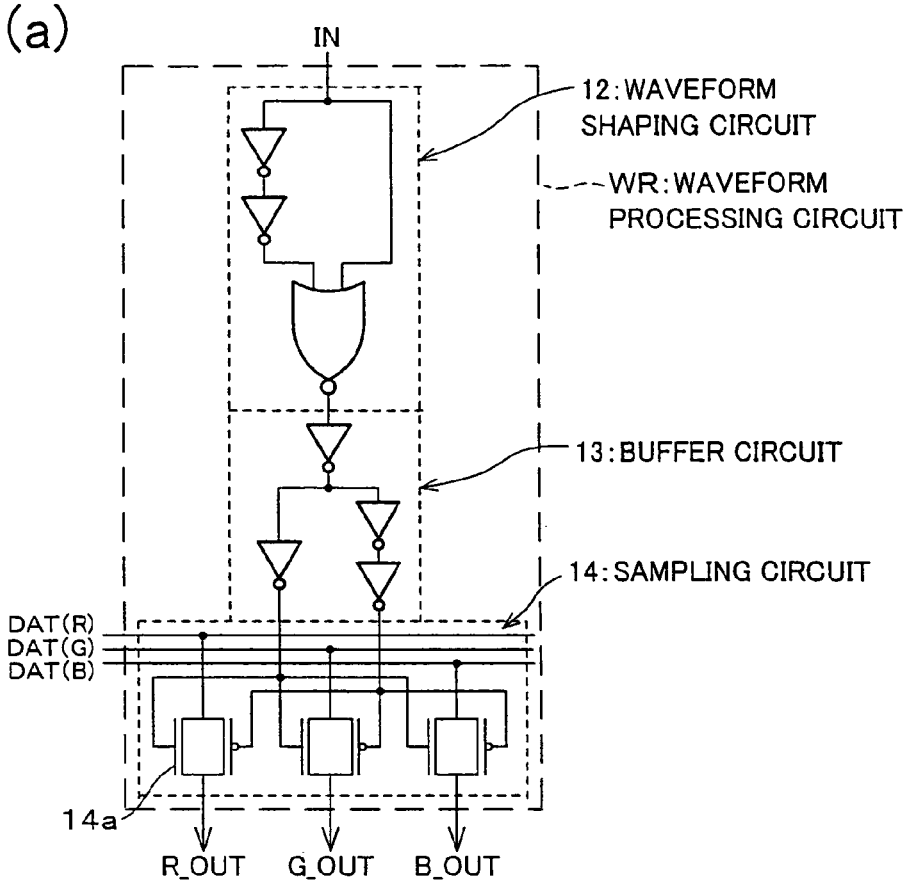
FIGS. 5(*a*) and 5(*b*) are circuit diagrams, each illustrate an arrangement example of a waveform processing circuit used for the foregoing data signal line driving circuit. More specifically, FIG. 5(*a*) illustrates an arrangement of color display using an analog image signal, and not using multiple-system operation.
Figure 5:
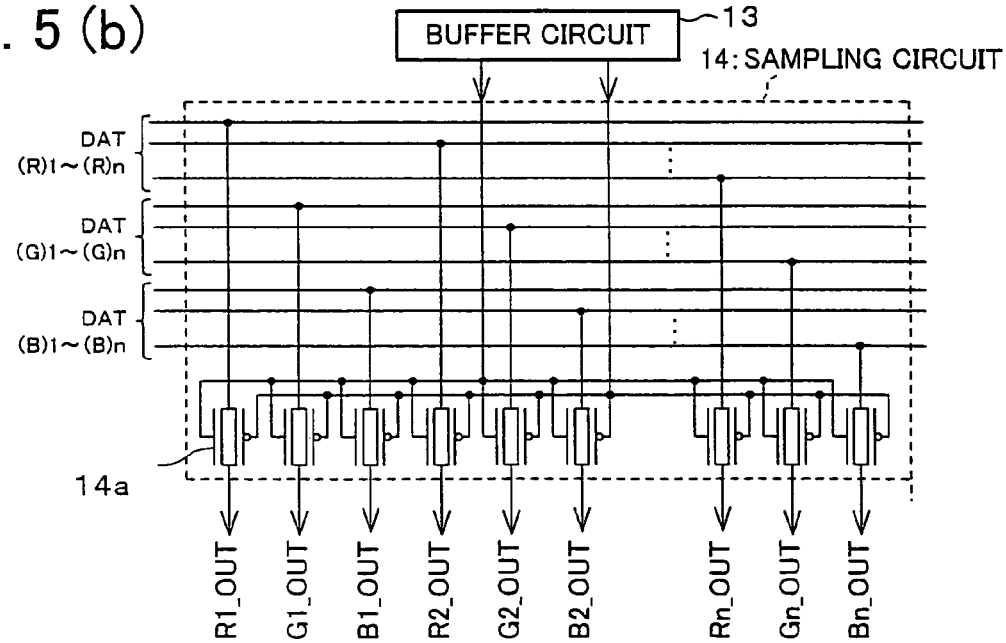

On the other hand, the structures shown in FIGS. 5(*a*) and 5(*b*) are both used for color display, and provided with the analog signal DAT composed of three-color (RGB) data. The structure shown in FIG. 5(*a*) is used for one-phase driving, and the structure of FIG. 5(*b*) is used for an n-phase driving. Note that, since the difference between the one-phase driving and the n-phase driving is only the number of sampling element 14*a* of the sampling circuit 14 which is operated by an output of the buffer circuit 13; more specifically, the monochrome one-phase driving requires one sampling element and color one-phase driving requires three (RGB) sampling elements, and the monochrome n-phase driving requires n sampling elements (for n image signal lines), and the color n-phase driving requires n×3 (RGB×n) sampling elements. Therefore, FIGS. 4(*b*) and 5(*b*) both only show a structure of the sampling circuit 14.

The waveform shaping circuit 12 adjusts the pulse width of an output signal (selection signal) of corresponding flip-flop F/F of the shift register SR, the buffer circuit 13 buffers the output whose pulse width is thus modified, and the sampling circuit 14 samples the analog image signal DAT and then outputs the signal to the data signal line SL during the period where the output of the buffer circuit 13 is kept in high-level.

Here, in case of monochrome display by one-phase driving, the image signal DAT is sampled from one image signal line and then outputted to one data signal line SL. Further, in case of monochrome display by n-phase driving, the image signals DAT1 through DATn are simultaneously sampled from n image signal lines, and then simultaneously outputted to n data signal lines SL. Further, in case of color display by one-phase driving, the image signals DAT (R), DAT (G), DAT (B) are simultaneously sampled from three image signal lines for R, G and B, and then simultaneously outputted to the respective data signal lines SL for each color. Further, in case of color display by the n-phase driving, the image signals DAT (R)1 through (R)n, DAT (G)1 through (G)n, and DAT (B)1 through (B)n are simultaneously sampled from n sets of three image signal lines for R, G and B, and then simultaneously outputted to n sets of data signal lines SL, each of which includes three signal lines for R, G and B.

Note that, the waveform processing circuits WR shown in FIGS. 4(*a*) and 4(*b*), 5(*a*) and 5(*b*) are only representative examples of the waveform processing circuits used in the data signal line driving circuit for analog signals, and therefore, the waveform processing circuit WR of the present invention is not limited to this type of circuit. Further, the present invention does not always require all of the waveform shaping circuit 12, the buffer circuit 13 and the sampling circuit 14; and also allow provision of different circuits, such as a level shifter circuit or the like.

Figure 6:
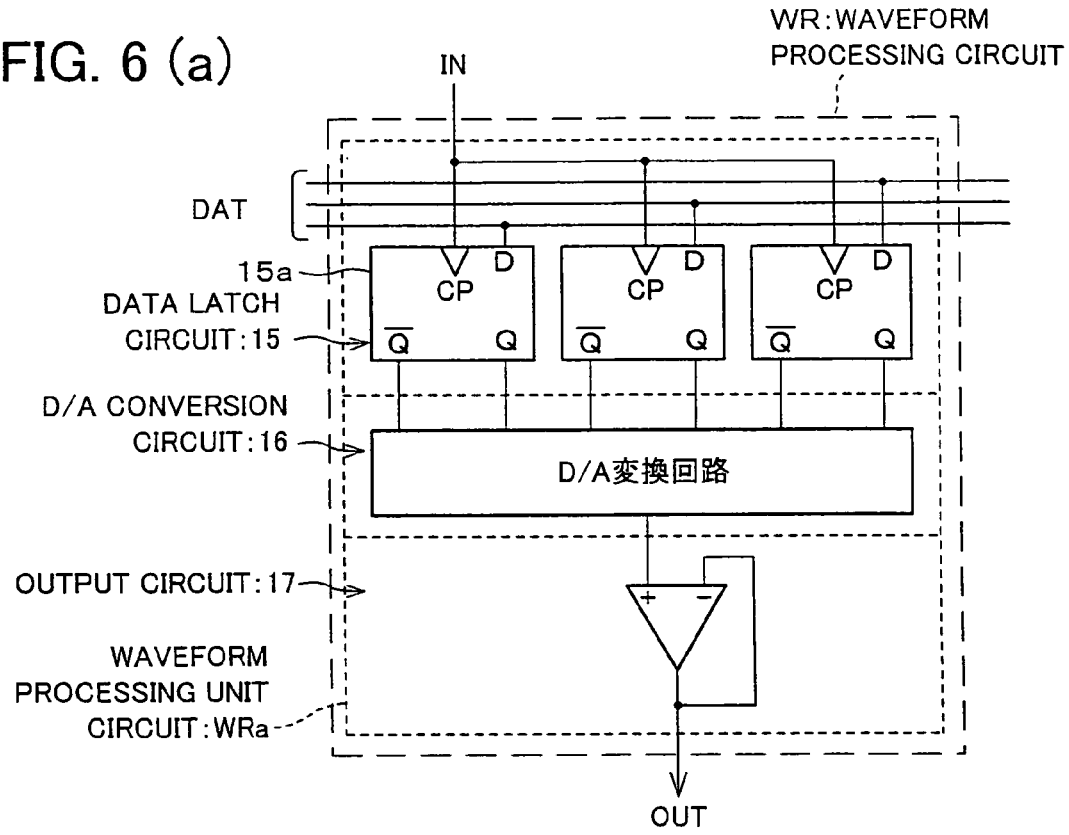
FIG. 6(*a*) is a circuit diagram illustrating an arrangement example of a waveform processing circuit used for the foregoing data signal line driving circuit; more specifically, the arrangement carries out monochrome display using a three-bit digital image signal, without using multiple-system operation.
Figure 6:
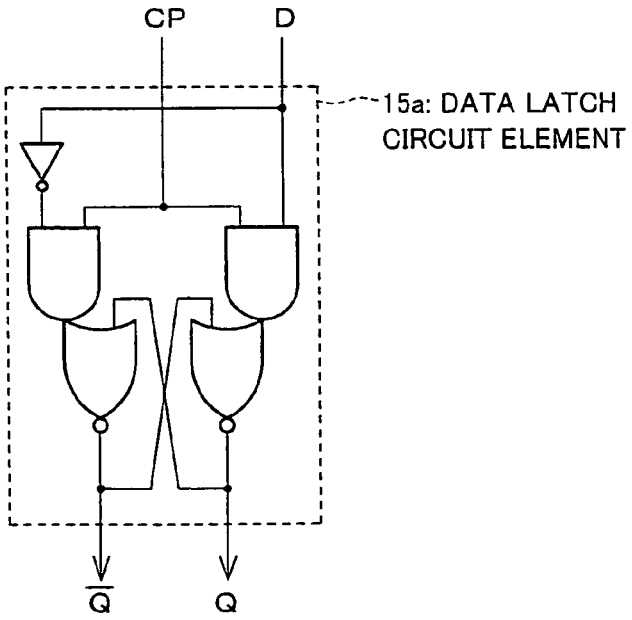
Figure 7:
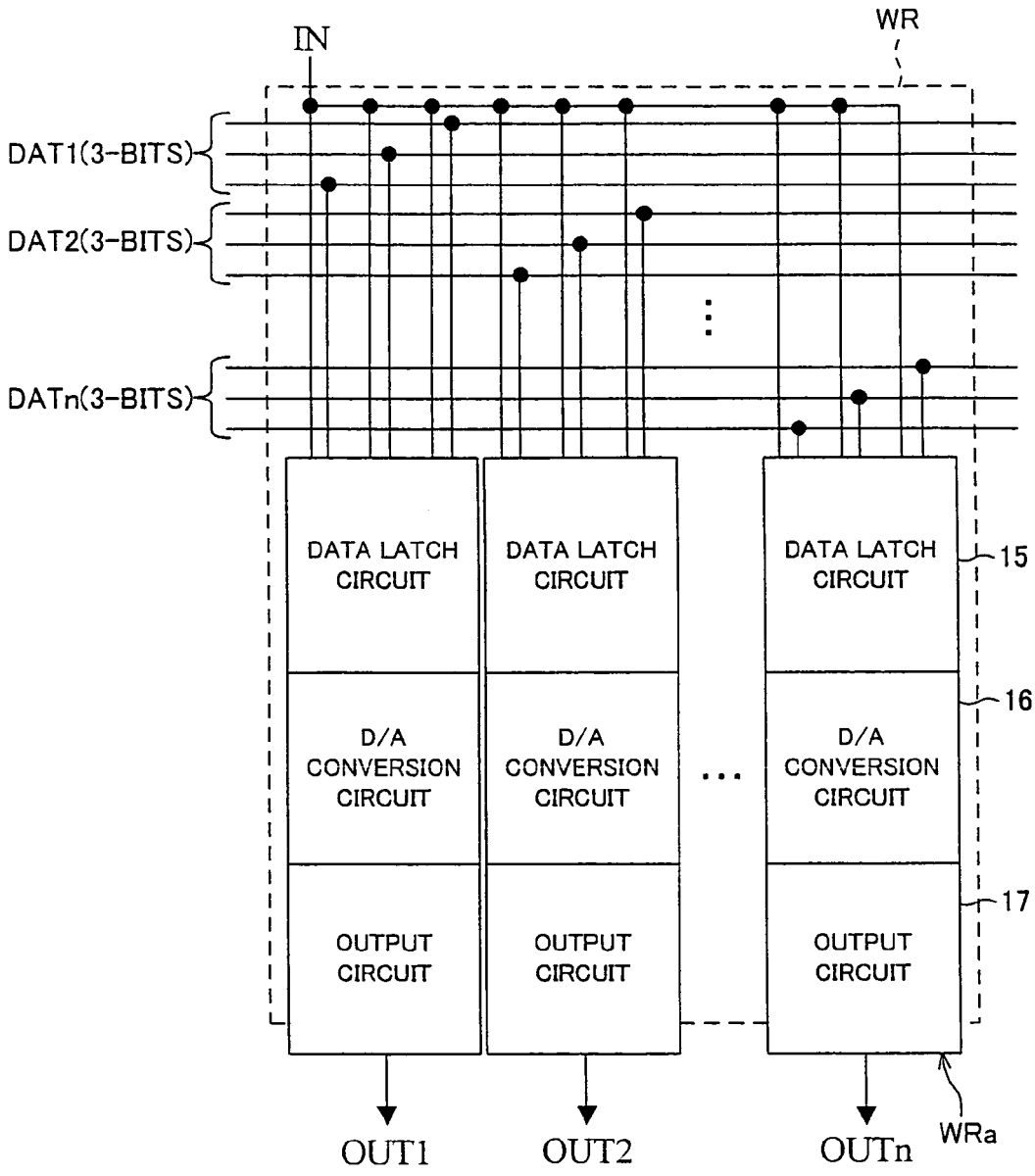
FIG. 7 is a circuit diagram illustrating an arrangement example of a waveform processing circuit used for the foregoing data signal line driving circuit; more specifically, the arrangement carries out monochrome display using a three-bit digital image signal and n-system operation.
Figure 8:
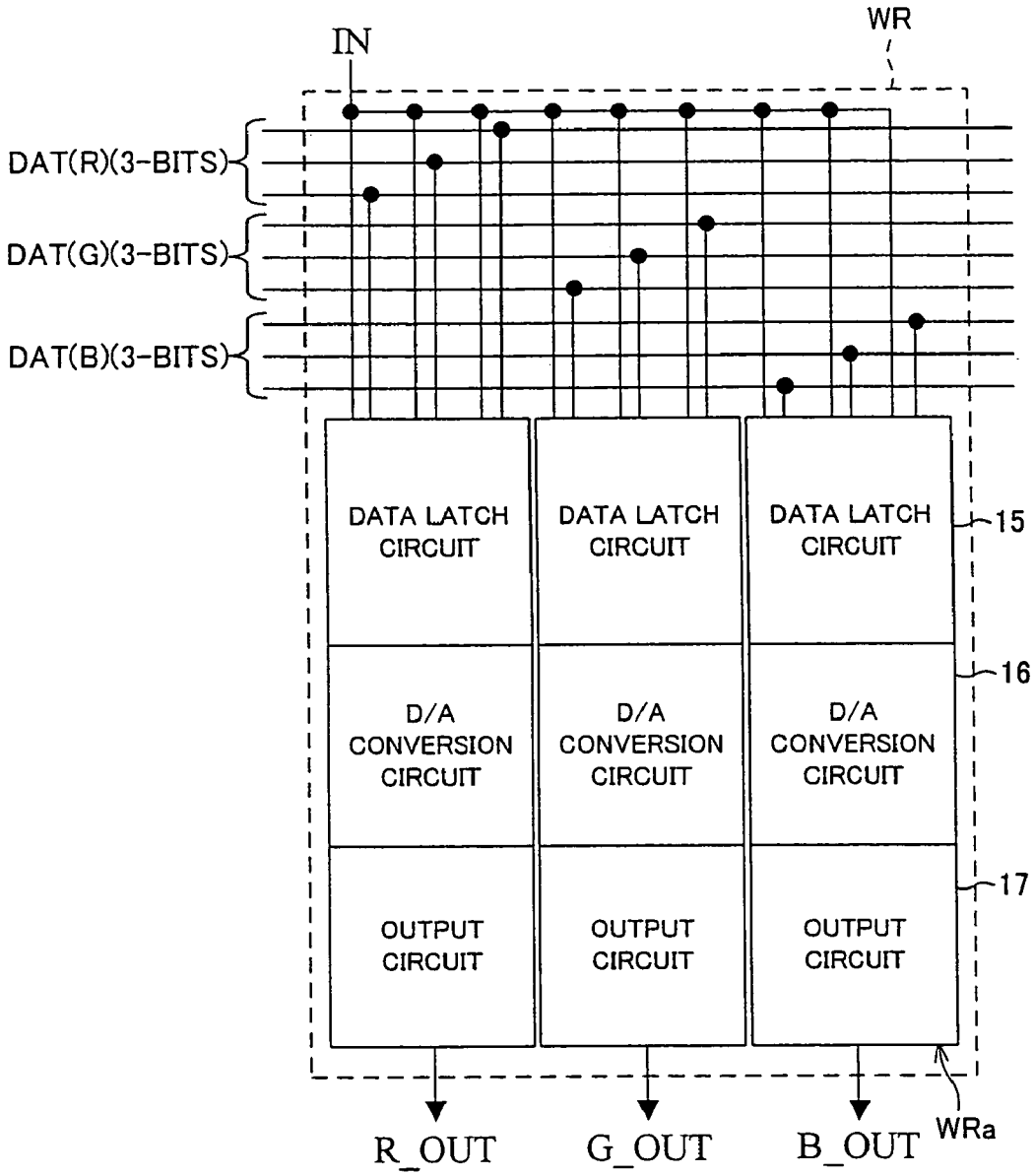
FIG. 8 is a circuit diagram illustrating an arrangement example of a waveform processing circuit used for the foregoing data signal line driving circuit; more specifically, the arrangement carries out color display using a three-bit digital image signal and not using multiple-system operation.
Figure 9:
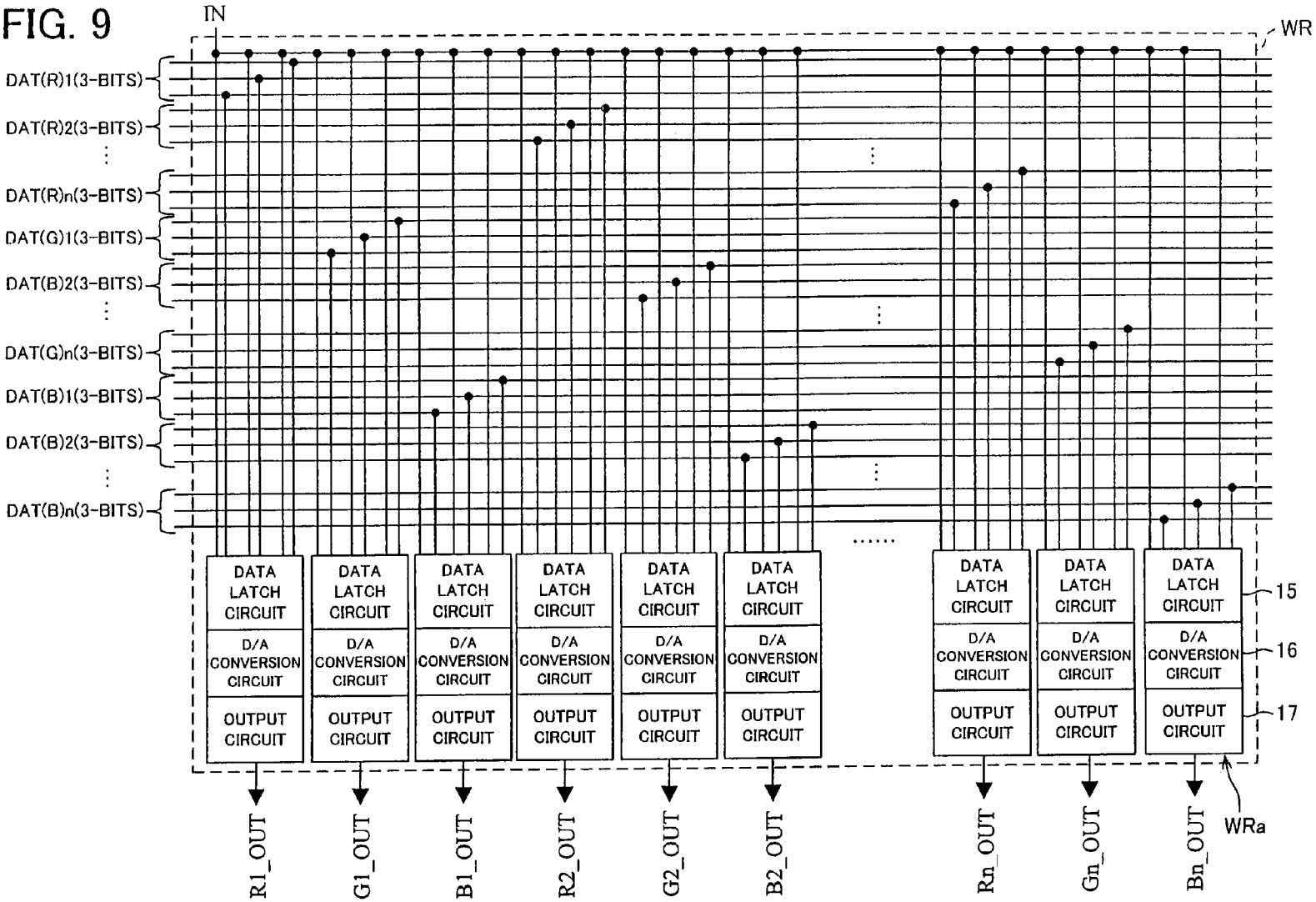
FIG. 9 is a circuit diagram illustrating an arrangement example of a waveform processing circuit used for the foregoing data signal line driving circuit; more specifically, the arrangement carries out color display using a three-bit digital image signal and n-system operation.

Further, when the image signal DAT is a digital signal, the waveform processing circuit WR may be constituted of, as shown in FIGS. 6(*a*), 7, 8 or 9, a data latch circuit 15, a analog/digital conversion circuit (hereinafter referred to as a D/A conversion circuit) 16, and an output circuit 17, for example. FIG. 6(*a*) shows a structure for 3-bits monochrome display by one-phase driving, FIG. 7 shows a structure for 3-bits monochrome display by n-phase driving. Further, the structures shown in FIGS. 8 and 9 are both used for color display with a 3-bits image signal DAT constituted of three-color (RGB) data, which are respectively for one-phase driving, and for an n-phase driving.

The data latch circuit 15 includes three data latch circuit elements 15*a* corresponding to the bit number of the digital image signal so as to sample the digital image signal. The data latch circuit 15, the D/A converter circuit 16, and the output circuit 17 constitute a unit of waveform processing unit circuit WRa. The required unit number of the waveform processing unit circuits WRa is determined according to the number of image signals. More specifically, the structure of FIG. 6(*a*) for 3-bits monochrome display by one-phase driving requires only one waveform processing unit circuit WRa, the structure for 3-bits monochrome display by n-phase driving of FIG. 7 requires n waveform processing unit circuits WRa. Further, the structure for color display with a 3-bits image signal DAT constituted of three-color (RGB) data by one-phase driving shown in FIG. 8 requires three waveform processing unit circuits WRa for each color (RGB), and the structure for color display with a 3-bits image signal DAT constituted of three-color (RGB) data by n-phase driving shown in FIG. 9 requires n×3 waveform processing unit circuits WRa for driving each color of RGB with n-phases.

FIG. 6(*b*) shows a typical arrangement example of the data latch circuit element 15*a*. Here, the data latch circuit element 15*a* is made up of two NOR circuits, two AND circuits, and an inverter. In this example, during a period where the input signal CP is high, an output signal Q and an output signal Q bar (an inversion signal of Q) change depending on whether the input signal D is high-level or low level. Also, during a period where the input signal CP is low, the output signal Q and the output signal Q bar are kept in the levels thus changed depending on whether the input signal D is high-level or low level.

Accordingly, the data latch circuit 15 uses an output signal (output pulse) of corresponding flip-flop of the shift register as the input signal CP, and uses the digital image signal DAT which is externally supplied as the input signal D, so as to sample the digital image signal DAT to each data latch circuit element 15*a* by using the output signal (output pulse) of corresponding flip-flop of the shift register as the trigger signal.

The D/A conversion circuit 16 selects an analog voltage depending on the result of sampling, and then outputs the selected analog voltage to the data signal line SL via the output circuit (output buffer) 17.

Here, in case of 3-bits monochrome display by one-phase driving, the 3-bits image signal DAT is sampled by one waveform processing unit circuit WRa, and then is outputted to one data signal line SL. Further, in case of 3-bits monochrome display by n-phase driving, the 3-bits image signals DAT1 through DATn are simultaneously sampled by n waveform processing unit circuits WRa, and then are simultaneously outputted to n data signal lines SL. Further, in case of 3-bits color display by one-phase driving, the image signals DAT (R), DAT (G), DAT (B) are simultaneously sampled by three waveform processing unit circuits WRa for R, G and B, and then are simultaneously outputted to three data signal lines SL for each color. Further, in case of 3-bits color display by the n-phase driving, the image signals DAT (R)1 through (R)n, DAT (G) 1 through (G)n, and DAT (B) 1 through (B)n are simultaneously sampled by n×3 waveform processing unit circuits WRa for R, G and B, and then are simultaneously outputted to n sets of data signal lines SL, each of which includes three signal lines for R, G and B.

Note that, the waveform processing circuits WR shown in FIGS. 6 through 9 are also only representative examples of the waveform processing circuits used in the data signal line driving circuit for digital signals, and therefore, the waveform processing circuit WR of the present invention is not limited to this type of circuit. Further, the present invention does not always require all of the data latch circuit 15, the D/A conversion circuit 16 and the output circuit 17; and also allow provision of different circuits, such as a level shifter circuit, a decoder circuit, or the like.

Figure 10:
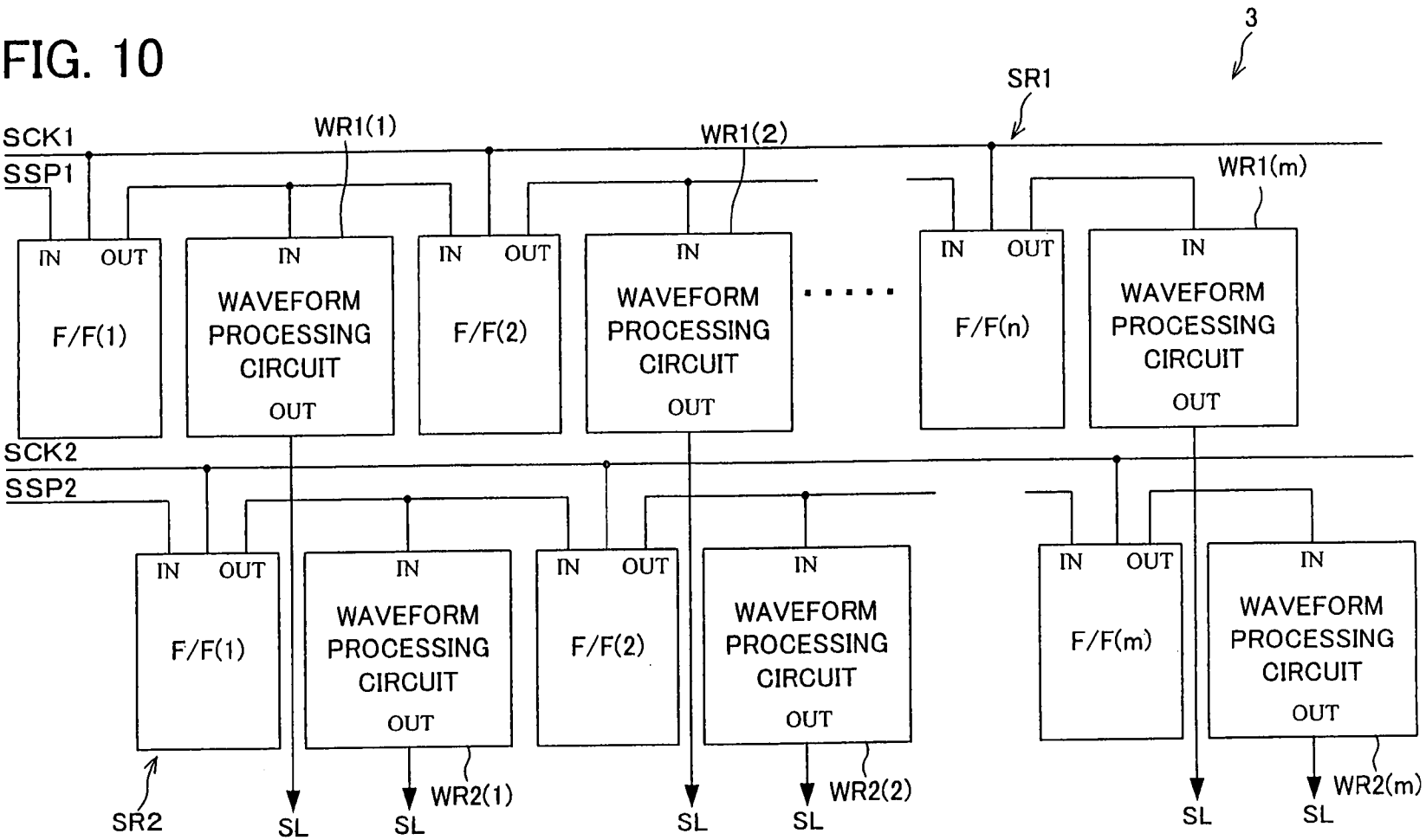
FIG. 10 is a block diagram illustrating a layout of a main part of a data signal line driving circuit according to another embodiment of the present invention.

For the next example, FIG. 10 shows a layout of the data signal line driving circuit 3 including a two-system shift register.

As shown in the figure, the data signal line driving circuit 3 is constituted of a first-system shift register SR1 and a second system shift register SR2, a plurality of waveform processing circuits WR1 through WR1(m) which are respectively supplied with output signals of respective output stages of the first shift register SR1, and operate as processing circuits for outputting the supplied signals, and a plurality of waveform processing circuits WR2 through WR2(m) which are respectively supplied with output signals of respective output stages of the second shift register SR1, and operate as processing circuits for outputting the supplied signals.

The first shift register SR1 is constituted of a plurality of flip-flops F/F1(1), F/F1(2), F/F1(m), which are supplied with a clock signal SCK1 and a start pulse signal SSP1 as control signals. The second shift register SR2 is constituted of a plurality of flip-flops F/F(1), F/F2(2), . . . F/F2(m), which are supplied with a clock signal SCK2 and start pulse signal SSP2 as control signals. The first system shift register SR1 and the second system shift register SR2 are adjacently disposed in the vertical direction. In this point, this example is the same as that of FIG. 18 having a conventional two-system shift registers sr1 and sr2.

As with the example of FIG. 1, a notable feature of this example is positioning of the plurality of waveform processing circuits WR1(1) through WR1(m) which are respectively provided between corresponding adjacent pairs of the plurality of flip-flops F/F1(1) through F/F1(m) constituting the first shift register SR1, and the plurality of waveform processing circuits WR2(1) through WR2(m) which are respectively provided between corresponding adjacent pairs of the plurality of flip-flops F/F2(1) through F/F2(m) constituting the second shift register SR2.

More specifically, the waveform processing circuit WR1(1) supplied with an output of the first-stage flip-flop F/F1(1) is provided between the first-stage flip-flop F/F1(1) and the second-stage flip-flop F/F1(2) which constitute the first-system shift register SR1. Likewise, the waveform processing circuit WR1(2) supplied with an output of the second-stage flip-flop F/F1(2) is provided between the second-stage flip-flop F/F1(2) and the third-stage flip-flop F/F1(3) (not shown). In this manner, the remaining waveform processing circuits WR1 are respectively provided between corresponding pair of adjacent flip-flops F/F1. The second-system shift register SR2 also has the same layout.

Figure 18:
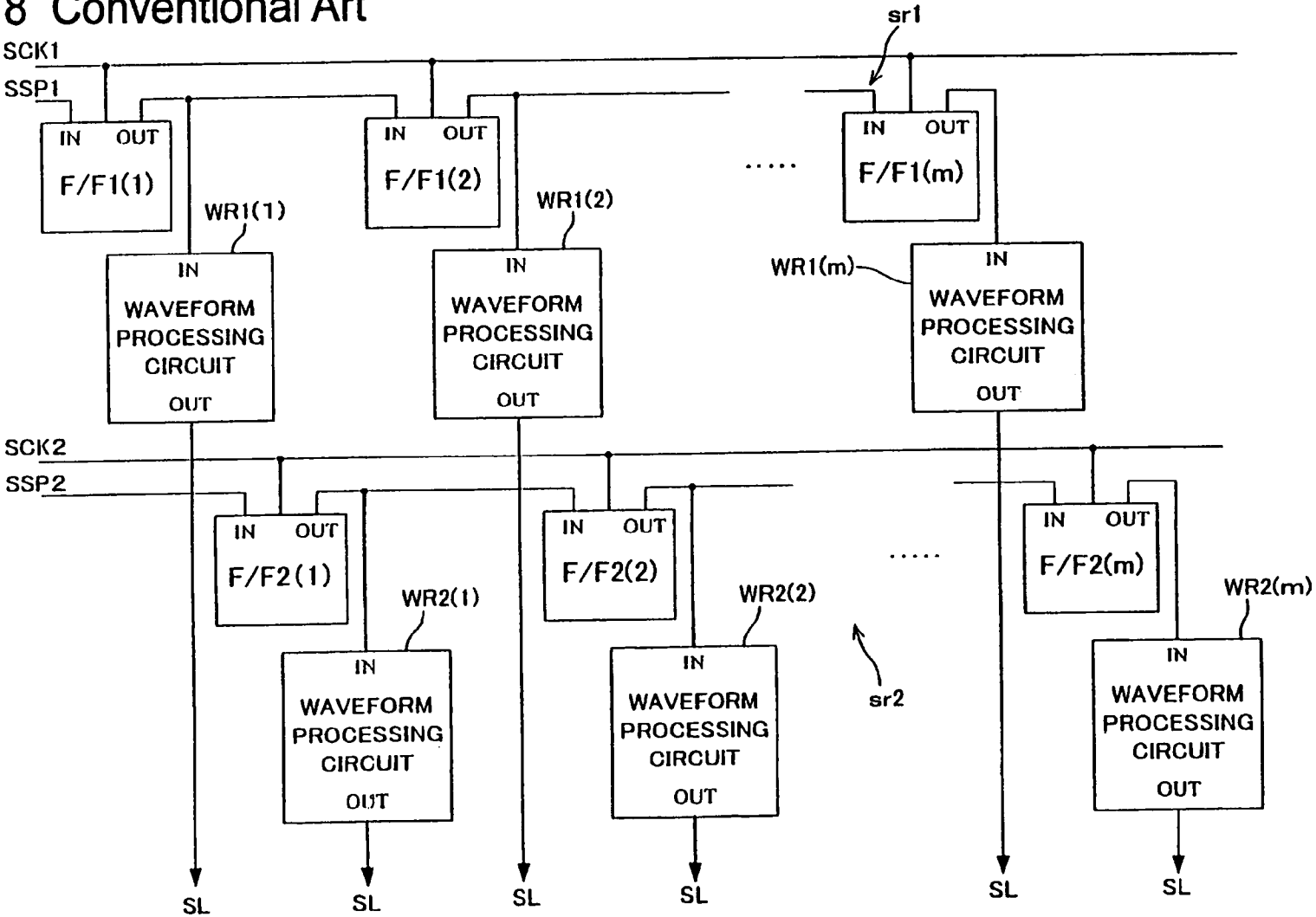
FIG. 18 Conventional Art
FIG. 18 is a block diagram illustrating another layout of a main part of a conventional data signal line driving circuit.
Figure 19:
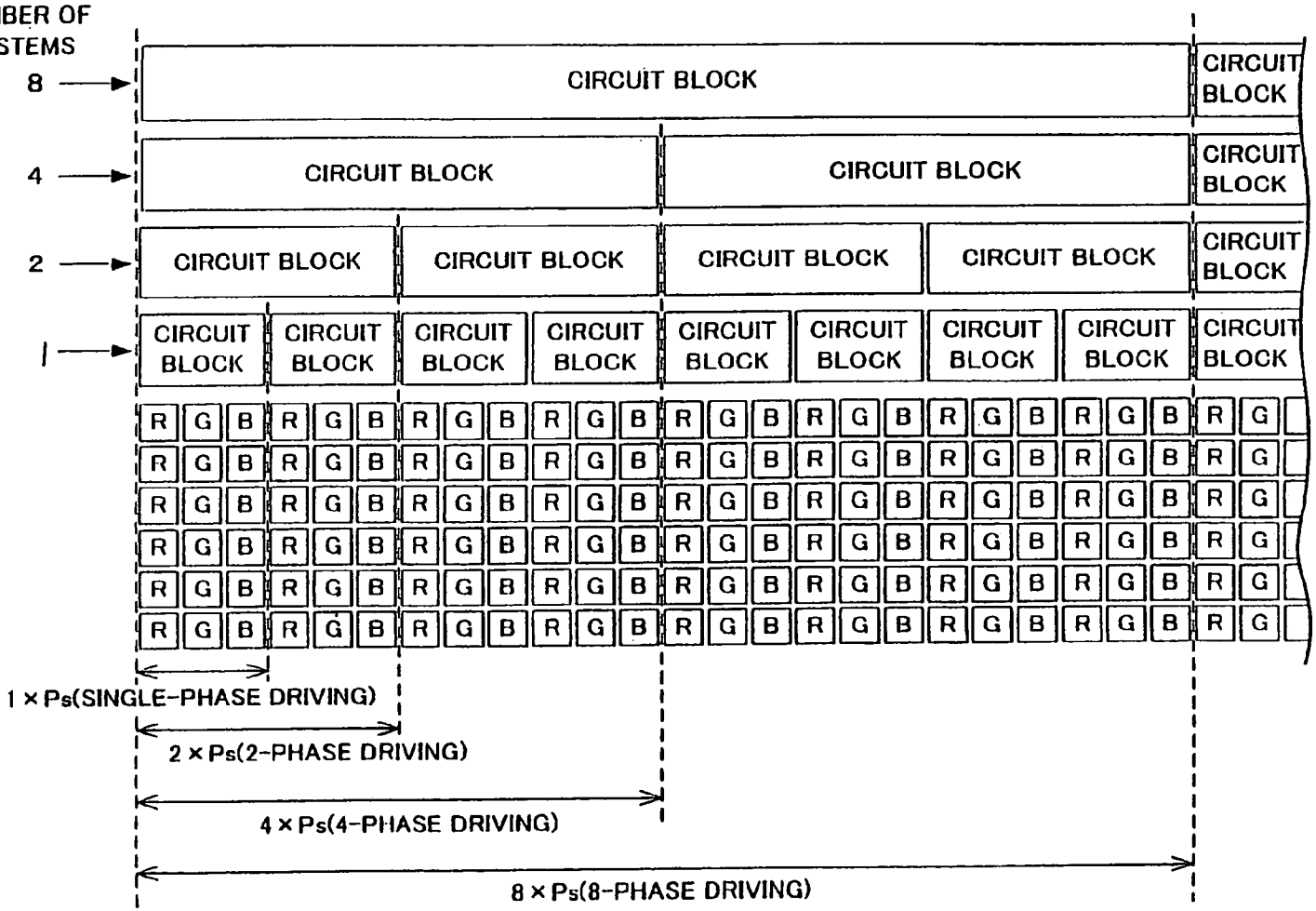
FIG. 19 Conventional Art
FIG. 19 is an explanatory view for showing the relation among the number of systems, the required number of circuit blocks, and the area for providing the circuit block, in case where a pixel array is driven by a multiple-system operation.
Figure 20:
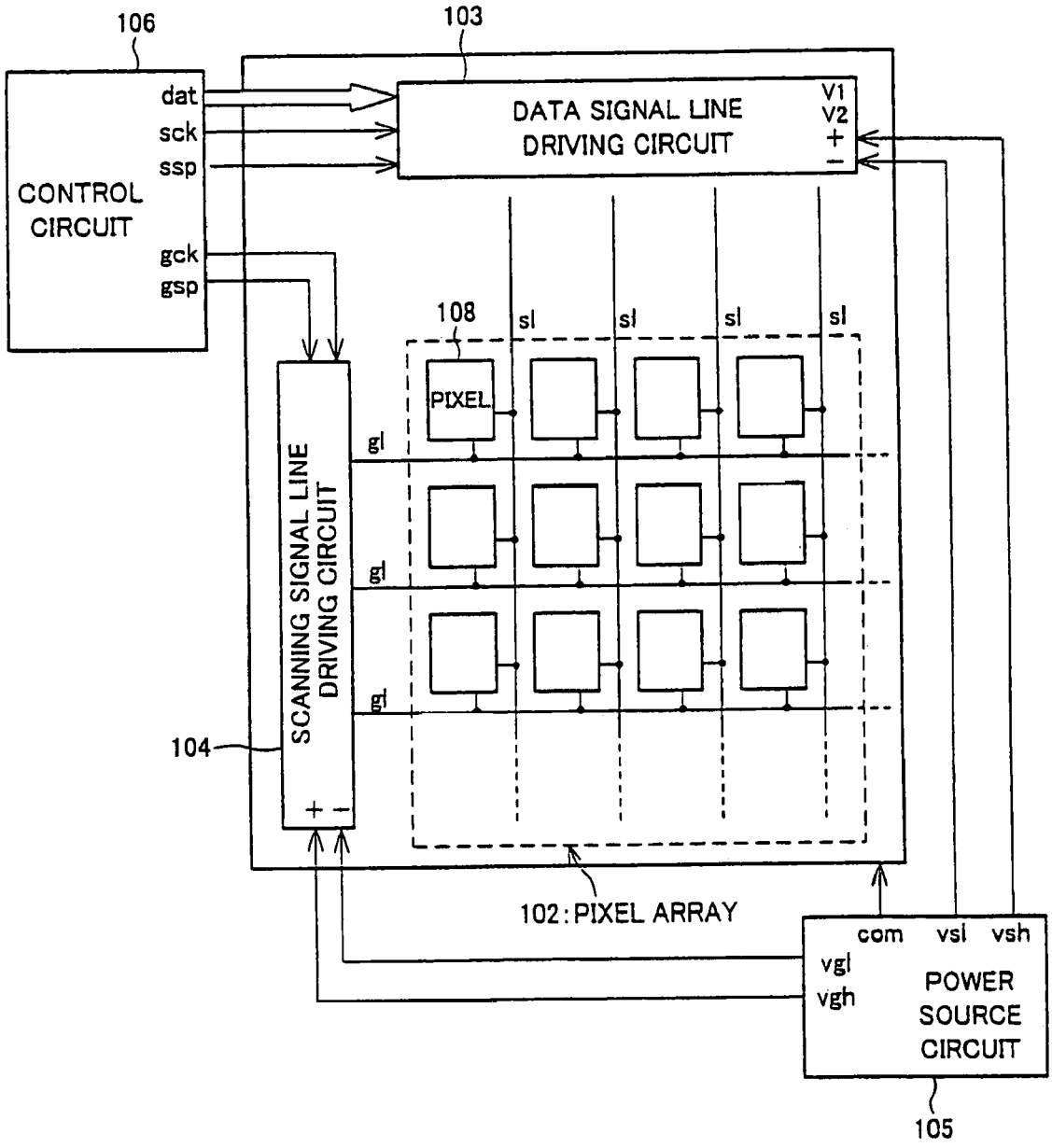
FIG. 20 Conventional Art
FIG. 20 is a block diagram illustrating an arrangement of a main part of an image display device including the foregoing data signal line driving circuit.

With such a layout, the area of the structure can be reduced in the horizontal direction compared to the conventional structure shown in FIG. 18, thus reducing frame area around the pixel array 2 of the image display device.

Figure 11:
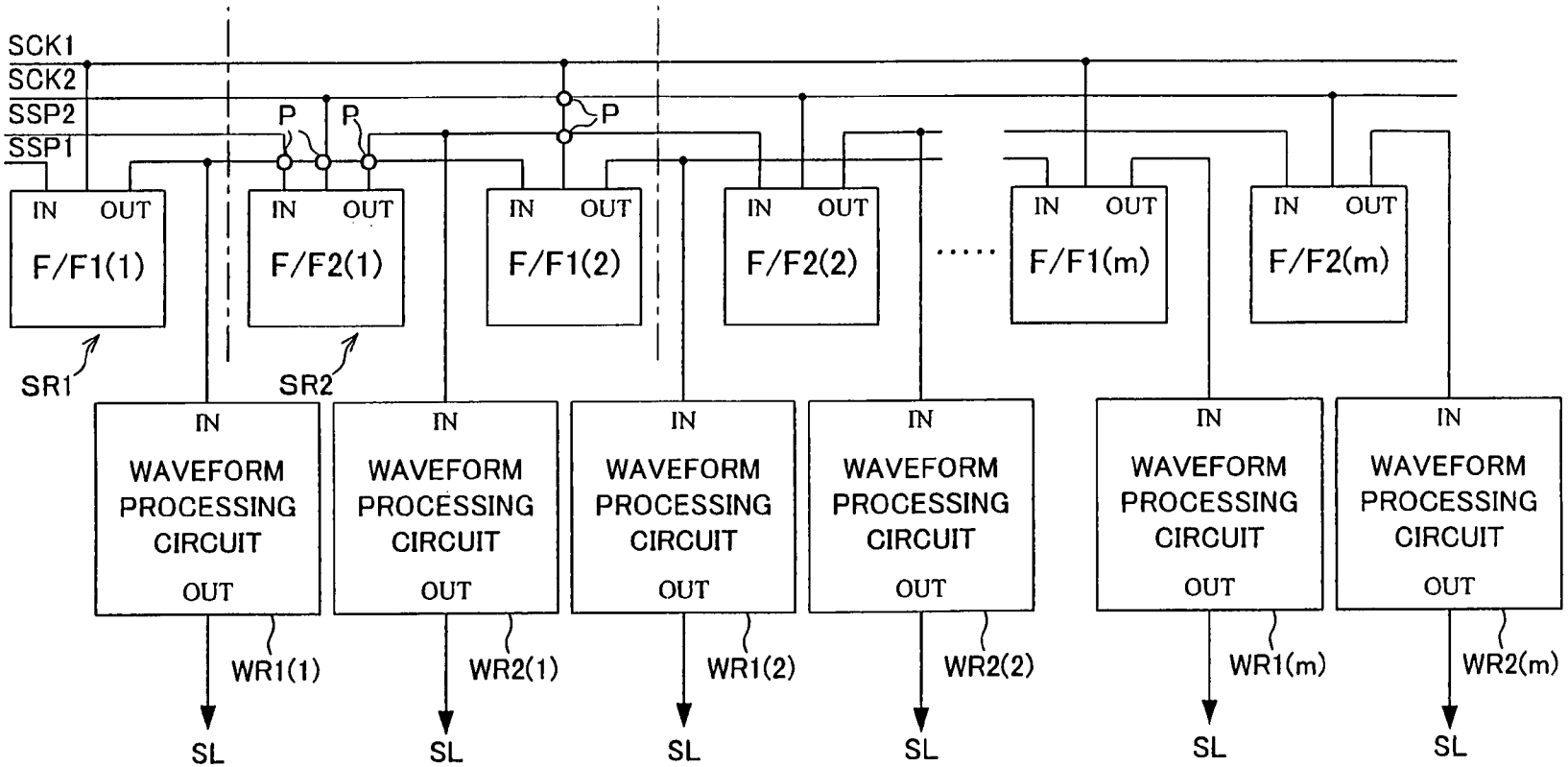
FIG. 11 is a block diagram illustrating a layout of a main part of a data signal line driving circuit according to still another embodiment of the present invention.
Figure 12:
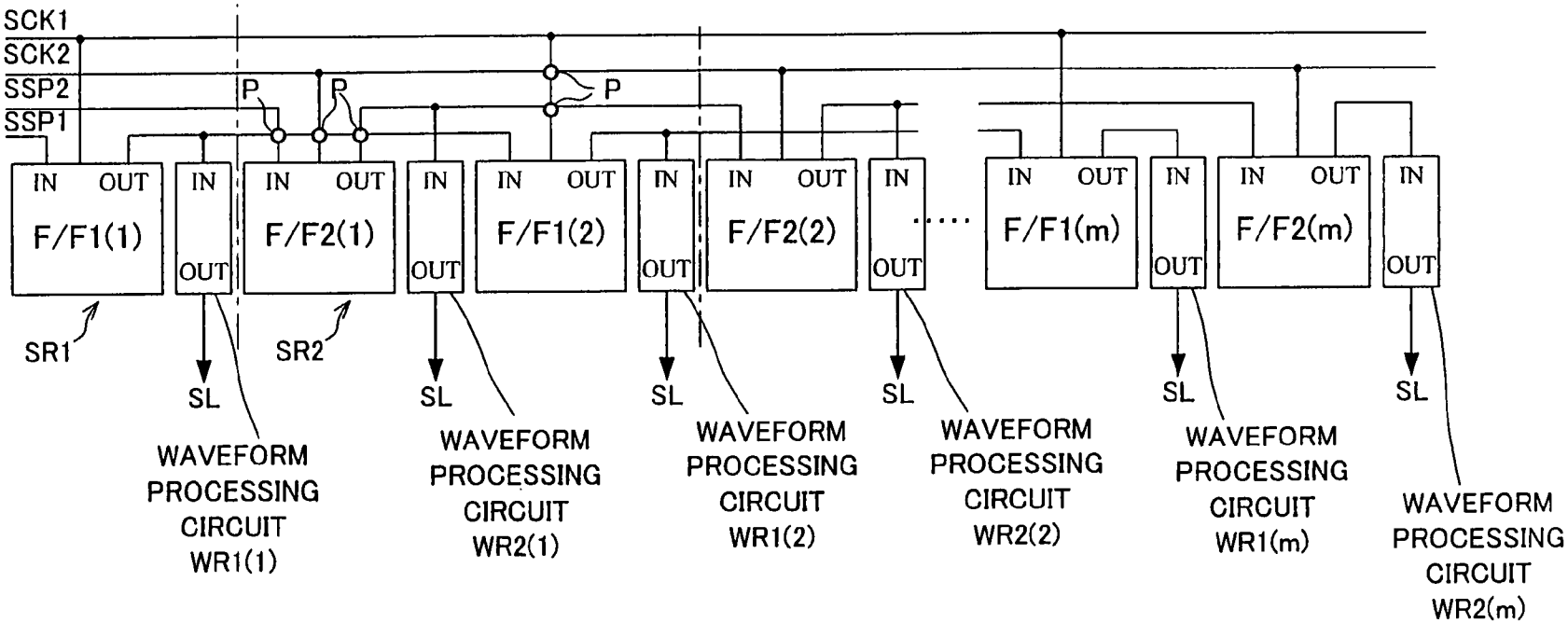
FIG. 12 is a block diagram illustrating a layout of a main part of a data signal line driving circuit according to yet another embodiment of the present invention.

Further, FIGS. 11 and 12 show another layout example of the data signal line driving circuit 3 including a two-system shift register.

In the data signal line driving circuit 3 shown in FIG. 11, the plurality of flip-flops F/F1(1) through F/F1(m) constituting the first shift register SR1 are respectively provided between corresponding adjacent pairs of the plurality of flip-flops F/F2(1) through F/F2(m) constituting the second shift register SR2, so that adjacent flip-flops belong to different systems to each other.

More specifically, the first-stage flip-flop F/F2(1) constituting the second-system shift register SR2 is provided between the first-stage flip-flop F/F1(1) and the second-stage flip-flop F/F1(2) which constitute the first-system shift register SR1, and the second-stage flip-flop F/F2(2) constituting the second-system shift register SR2 is provided between the second-stage flip-flop F/F1(2) and the third-stage flip-flop F/F1(3) (not shown) which constitute the first-system shift register SR1. In this manner, the remaining flip-flops F/F2 are respectively provided next to the corresponding flip-flops F/F1, on the side to which the start pulse signal SSP is shifted.

Further, the waveform processing circuits WR1 and WR2 are provided as the waveform processing circuits WR1(1), WR2(1), WR1(2), . . . WR2(m) in this order in the vertical direction of those two-system shift registers, the waveform processing circuits WR1(1), WR2(1), WR1(2), . . . WR2(m) being vertically offset from the two-system shift registers in the direction toward which the start pulse signal SSP is shifted.

With this layout, the first-system shift register SR1 and the second-system shift register SR2 are linearly aligned, and wirings for supplying output signals can be unified in length in these two systems of the shift register block. Accordingly, delay time of the output signals can also be unified, and the problem of degradation of display quality due to variation of delay time can be solved without enlarging circuit scale for, for example, processing the start pulse signal SSP between the two systems.

In the structure shown in FIG. 10, two circuits having totally different functions are in alignment with each other, such as the pair of the flip-flop F/F1 and the waveform processing circuit WR1, or the pair of the flip-flop F/F2 and the waveform processing circuit WR2. This structure may require extra space between the alignment on which the flip-flop F/F1 and the waveform processing circuit WR1 are provided, and the alignment on which the flip-flop F/F2 and the waveform processing circuit WR2 are provided, when layout length in the vertical direction differs between the flip-flop F/F1 and the waveform processing circuit WR1, or between the flip-flop F/F2 and the waveform processing circuit WR2.

On the other hand, the structure shown in FIG. 11 is arranged so that the circuits in different systems but having the same function are in alignment. This structure does not require the foregoing extra space due to difference in layout length in the vertical direction, since the alignments in this structure is respectively made up of a plurality of shift registers SR1 and SR2, and a plurality of waveform processing circuits WR1 and WR2.

Consequently, layout area in the vertical direction may further be reduced, thus narrowing the frame area around the pixel array 2 of the image display device.

Further, in the data signal line driving circuit 3 shown in FIG. 12, one of the flip-flops F/F2(1) through F/F2(m) constituting the second-system shift register SR2 is provided between each adjacent pairs of the flip-flops F/F1(1) through F/F1(m) constituting the first-system shift register SR1, so that all adjacent flip-flops F/F alternately belong to the first system or the second system. In this structure, the waveform processing circuits WR1 and WR2 respectively supplied with outputs of the flip-flops F/F1 and F/F2 are provided by being out of alignment with corresponding flip-flops F/F1 and F/F2 in the signal shifting direction.

More specifically, the waveform processing circuit WR1(1) supplied with an output signal of the first-stage flip-flop F/F1(1) is provided between the first-stage flip-flop F/F1(1) and the second-stage flip-flop F/F1(2), which constitute the first system shift register SR1. Then, the waveform processing circuit WR1(1) is followed (in the signal shifting direction) by the flip-flop F/F2(1) constituting the second-system shift register SR2, which is further followed by the waveform processing circuit WR2(1) supplied with an output signal of the first-stage flip-flop F/F2(1) belonging to the second-system shift register SR2. The remaining flip-flops F/F and the waveform processing circuits WR are aligned also in this manner.

With such a layout, as well as the first and second-systems shift registers SR1 and SR2, the respective waveform processing circuits WR1 and WR2 supplied with output signals of the first and second systems shift registers SR1 and SR2 are also linearly aligned.

Consequently, delay time of the output signals can be unified between the two systems in the shift register block, and the problem of degradation of display quality due to variation of delay time can be solved without enlarging circuit scale. Further, the layout area in the vertical direction is minimized compared with the structures of FIGS. 10 and 11, thus further narrowing the frame area around the pixel array 2 of the image display device.

In the structures shown in FIGS. 11 and 12, conventional wiring is used for linearly (in alignment) disposing the first and second systems shift registers SR1 and SR2. In this case, the respective signal paths for the first-system shift register SR1 and the second-system shift register SR2 are both provided on one side (opposite of the output side of the shift register block, in this example) of the flip-flop alignment constituted of the flip-flops F/F1 and the flip-flops F/F2.

However, in this arrangement in which plural systems of wiring are provided on one side of the flip-flop alignment, the number of crossing sections between the respective signal lines increases in the layout. The crossing point of the signal line is denoted by P in the FIGS. 11 and 12.

The crossing point P has a parasitic capacitance, which may affect operation of the shift register block. Further, the increased number of crossing points P causes an increase of contact area for connecting plural metal layers, thus enlarging the layout area. Accordingly, it is preferable that the number of crossing points P is decreased by effectively using the layout area both in the vertical direction and the horizontal direction, so as to further reduce the frame area.

Figure 13:
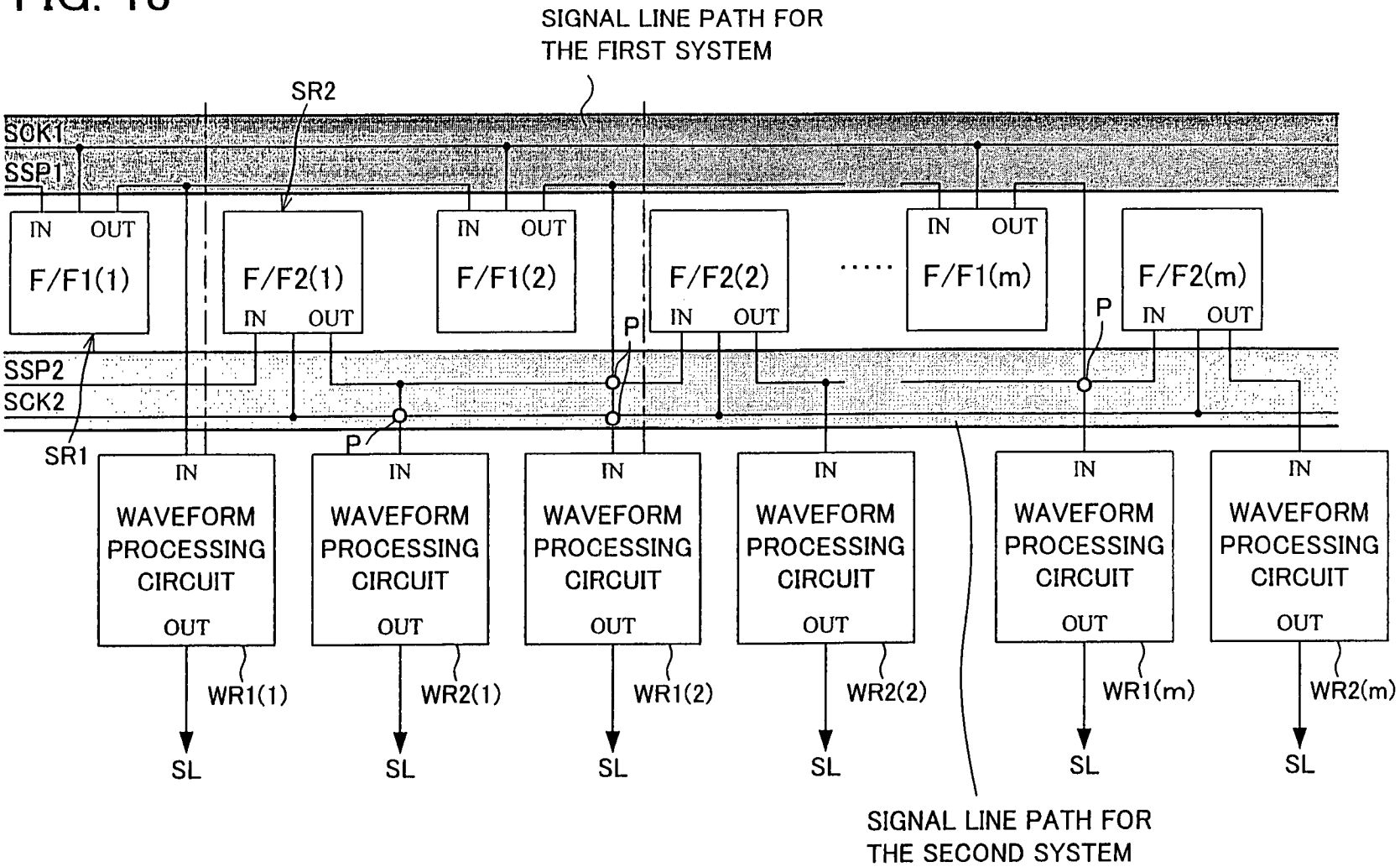
FIG. 13 is a block diagram illustrating a layout of a main part of a data signal line driving circuit according to a further embodiment of the present invention.
Figure 14:
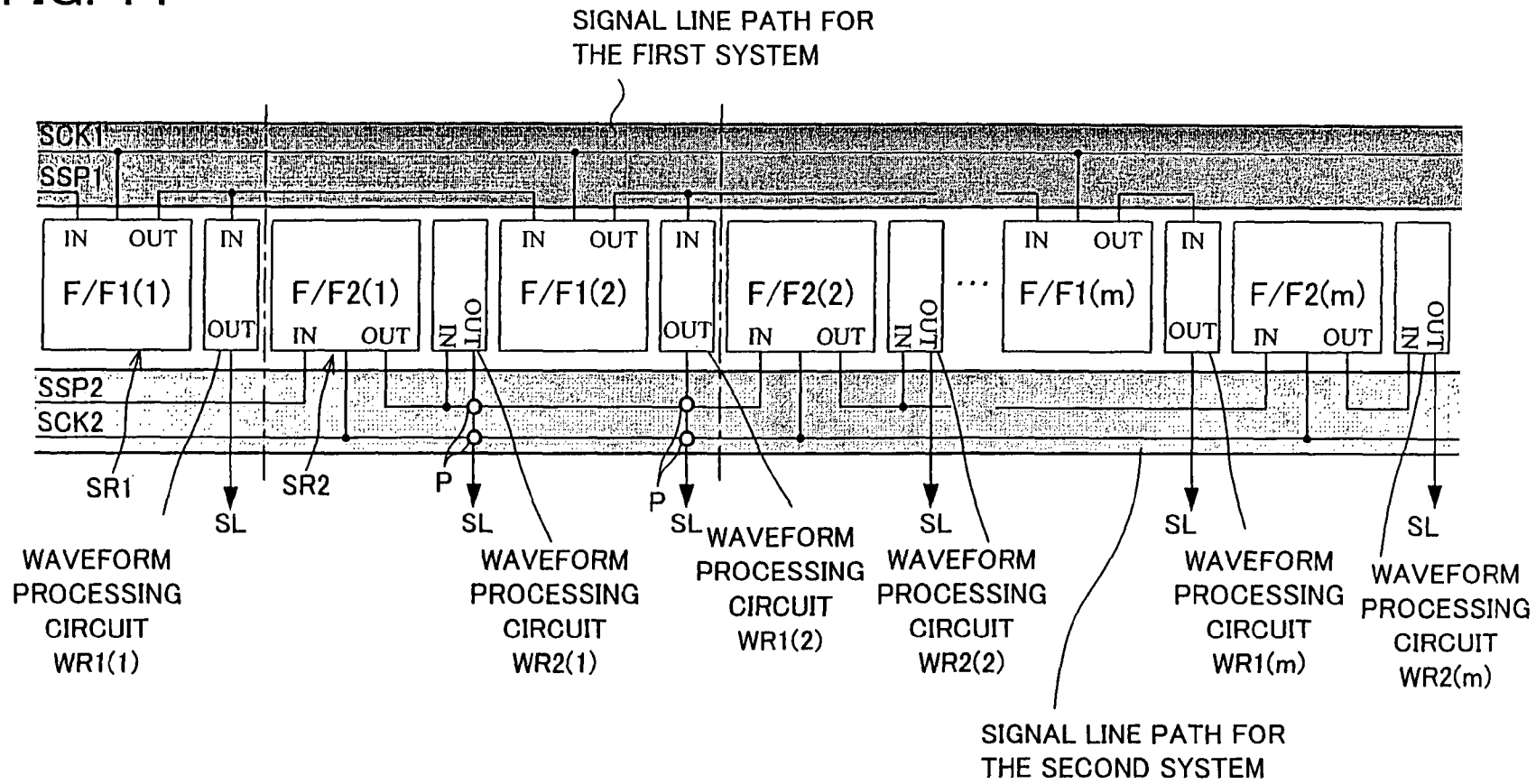
FIG. 14 is a block diagram illustrating a layout of a main part of a data signal line driving circuit according to a still further embodiment of the present invention.

FIGS. 13 and 14 show alternate layouts for reducing the number of crossing points P. FIGS. 13 and 14 correspond to FIGS. 11 and 12, respectively. In the data signal line driving circuit 3 shown in FIGS. 13 and 14, the signal line paths for the respective systems are separately provided on both sides of the flip-flop alignment constituted of the flip-flops F/F1 and the flip-flops F/F2. In this example, the signal line path (80) for the first-system shift register SR1 is provided on the opposite side of the output side of the shift register block, and the signal line path (81) for the second-system shift register SR2 is provided on the output side of the shift register block. In this arrangement, a less number of crossing points P exist between the respective signal lines, thus reducing the number of crossing points P in the layout.

For example, in comparison between FIGS. 11 and 13, the structure of FIG. 11 has 5 crossing points P in total within the area sectioned by the broken line. More specifically, wiring for the start pulse SSP2, wiring for the clock signal SCK2, and wiring for connecting the output terminal OUT of the flip-flop F/F2(1) and the input terminal IN of the flip-flop F/F2(2) create three crossing points P by intersecting with wiring for connecting the output terminal OUT of the flip-flop F/F1(1) and the input terminal IN of the flip-flop F/F1(2). Further, wiring for connecting the output terminal OUT of the flip-flop F/F2(1) and the input terminal IN of the flip-flop F/F2(2) and wiring for supplying the clock signal SCK2 creates two crossing points P by intersecting with wiring for supplying the clock signal SCK1 to the flip-flop F/F1(2).

On the other hand, the structure of FIG. 13 has three crossing points in the area sectioned by the broken line. More specifically, wiring for connecting the output terminal OUT of the flip-flop F/F2(1) and the input terminal IN of the waveform processing circuit WR2(1) create a crossing point P by intersecting with wiring for the clock signal SCK2; and wiring for connecting the output terminal OUT of the flip-flop F/F2(1) and the input terminal IN of the flip-flop F/F2(2) and wiring for the clock signal SCK2 create two crossing points P by intersecting with wiring for connecting the output terminal OUT of the flip-flop F/F2(1) and the input terminal IN of the flip-flop F/F2(2).

Further, in comparison with FIGS. 12 and 14, the structure of FIG. 12 has 5 crossing points in total within the area denoted by the broken line as with the structure of FIG. 11; however, the structure of FIG. 14 has 4 crossing points in total within the area denoted by the broken line. More specifically, wiring for the clock signal SCK2, and wiring for connecting the output terminal OUT of the flip-flop F/F2(1) and the input terminal IN of the flip-flop F/F2(2) create four crossing points P by intersecting with wirings for respectively connecting output terminals OUT of the waveform processing circuits WR2(1) and WR1(2) and corresponding data signal lines SL.

As described, the present embodiment adopts such a layout for a shift register block provided in the data signal line driving circuit 3 that two adjacent flip-flops F/F in the same system have therebetween circuits not involved in operation of the shift register of the system, such as a waveform processing circuit WR for using output of the shift register, or flip-flops F/F belonging to a different system.

Adoption of such a layout of the shift register block allows further reduction of the required layout area in the vertical direction, compared to a conventional arrangement of a shift register block.

Note that, though the present embodiment has described with a shift register having two systems, the present invention also allows an arrangement using a shift register having three or more systems. Further, the described shift register block may also be used for a scanning signal line driving circuit as required. Further, in the foregoing embodiment, the circuits not involved in operation of the shift register of the system, such as a waveform processing circuit WR for using output of the shift register, or flip-flops F/F belonging to a different system, are disposed between two adjacent flip-flops F/F in the same system at the same intervals; however, the present invention is not limited to this arrangement.

Further, the image display device 1 shown in FIG. 2 is supplied with an image signal DAT via the control circuit 6; however, in the case of dealing with digital data with a single system, or the case of optionally providing an analog data processing circuit (not shown), the image signal DAT may be externally supplied without passing through the control circuit 6.

Further, In FIG. 2, the pixel array 2, data signal line driving circuit 3 and the scanning signal line driving circuit 4 are simultaneously formed on the same insulation substrate 7 on which the pixels 8 are formed; however, the pixel array 2 and the respective driving circuits 3 and 4 may be formed on different substrates so as to be joined together by connecting the respective substrates to one another.

However, if there are any demands for reduction of manufacturing cost and/or mounting cost of the driving circuits, it is preferable that the pixel array 2 and the driving circuits 3 and 4 are monolithically formed on the same substrate. In this case, the work for connecting the separate substrates to one another can be omitted, thus improving reliability.

The following will briefly explain the structure and the manufacturing method of a transistor in which a polysilicon thin film transistor is used for the pixel array 2, and active elements of the driving circuits 3 and 4.

Figure 15:
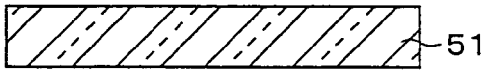
FIGS. 15(*a*) through 15(*k*) are cross-sectional views for showing manufacturing processes of a thin film transistor constituting the foregoing image display device by illustrating a cross-section of a substrate in each manufacturing step.
Figure 15:
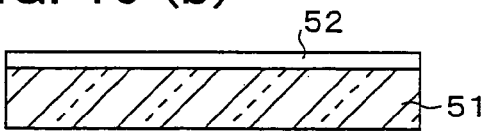
Figure 15:
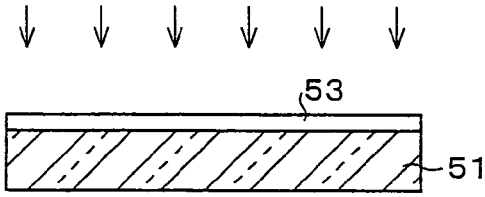
Figure 15:
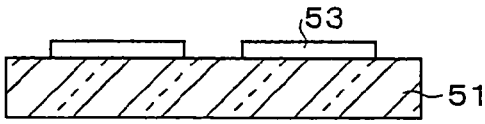
Figure 15:
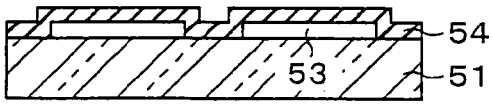
Figure 15:
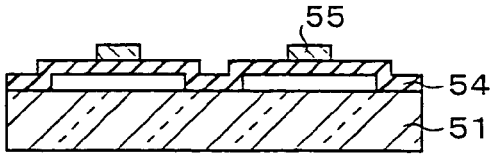
Figure 15:
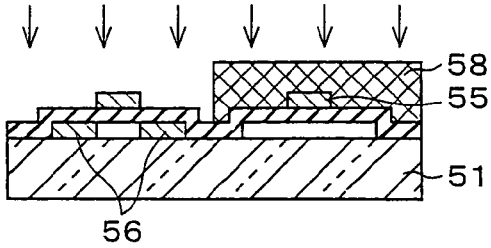
Figure 15:
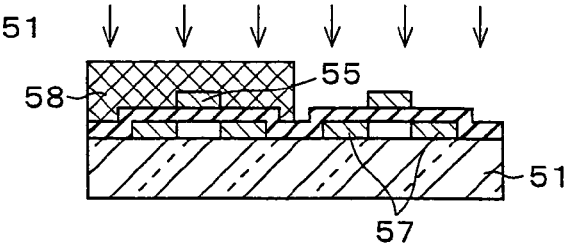
Figure 15:
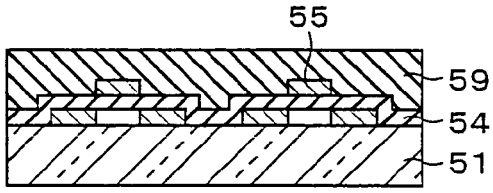
Figure 15:
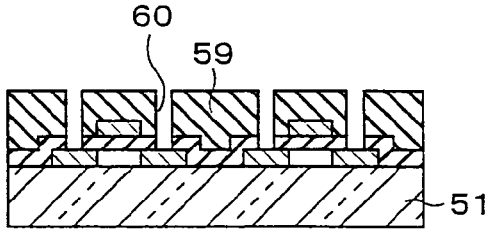
Figure 15:
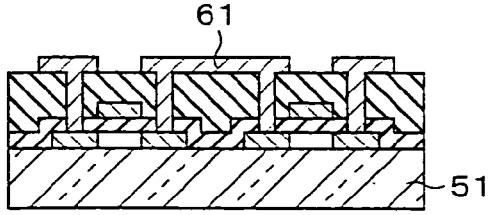

As shown in FIGS. 15(*a*) and 15(*b*), an amorphous silicon thin film 52 is piled up on a grass substrate 51. Further, as shown in FIG. 15(*c*), the amorphous silicon thin film 52 is irradiated with an excimer laser so as to be a polysilicon thin film 53.

Further, as shown in FIG. 15(*d*), the polysilicon thin film 53 is patterned to be an arbitrary shape, and a gate insulation film 54 made of a silicon dioxide is formed on the polysilicon thin film 53, as shown in FIG. 15(*e*).

Further, a gate electrode 55 for a thin film transistor is formed by an aluminum or the like on the gate insulation film 54 as shown in FIG. 15(*f*), and then, as shown in FIGS. 15(*g*) and 15(*h*), impurities are injected into areas 56 and 57, which are respectively to be a source area and a drain area of the thin film transistor. Here, a phosphorus is injected in an n-type area 56, and an boron is injected in a p-type area 57. Note that, before one of the areas is subjected to the injection of the impurities, the remaining area is covered by the resist 58, thus supplying the impurities only to the desired area.

Further, as shown in FIG. 15(*i*), an interlayer insulation film 59 made of a silicon dioxide, a silicon nitride or the like is piled up on the gate insulation film 54 and the gate electrode 55, and then, a contact hole 60 is formed (opened) as shown in FIG. 15(*j*), and a metal wiring 61 is formed by an aluminum or the like as shown in FIG. 15(*k*).

Figure 16:
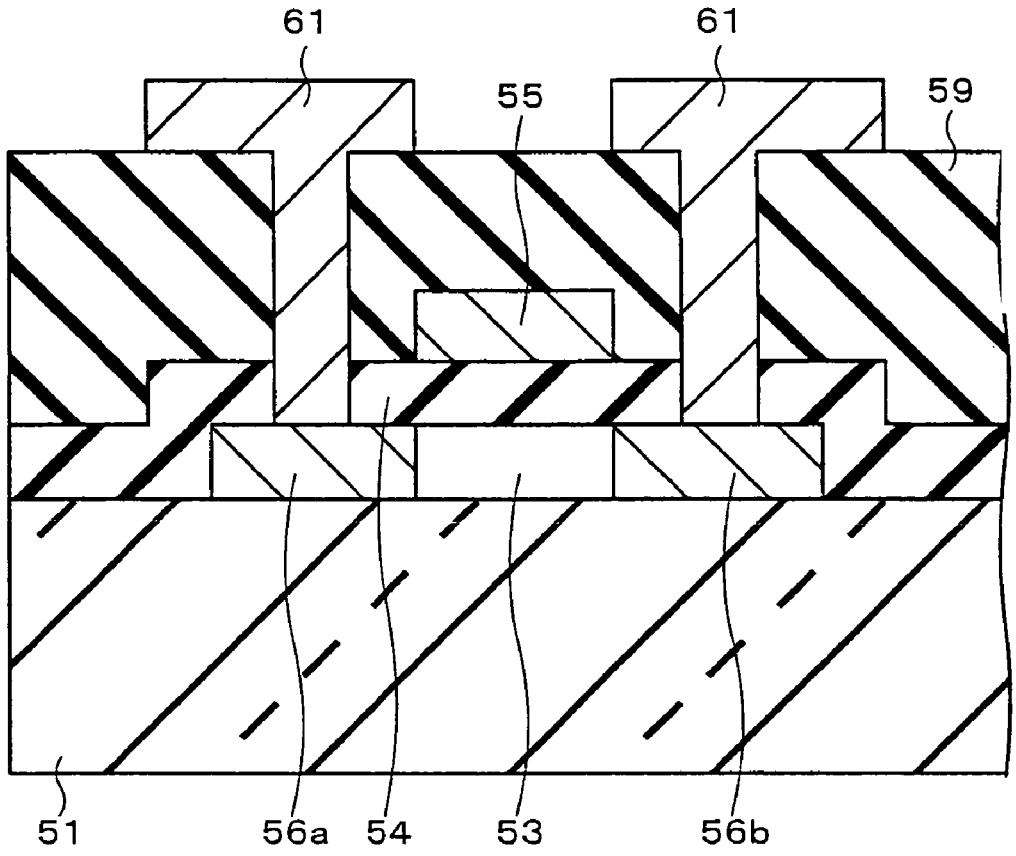
FIG. 16 is a cross-sectional view illustrating a structure of the foregoing thin film transistor.

Through these steps, a thin film transistor with a forward stagger (top-gate) structure including a polysilicon thin film on an insulation substrate as an active layer. The FIG. 16 shows an example of a n-ch transistor in which the n-type area 56 having areas 56*a* and 56*b* which have therebetween the polysilicon thin film 53 below the gate electrode 55 and will operate as a source area and a drain area, respectively.

By thus using a polysilicon thin film transistor, the data signal line driving circuit 3 and the scanning signal line driving circuit 4 with practical driving ability can be manufactured on the same substrate as that having the pixel array by substantially the same manufacturing step. The present invention is not limited to the foregoing structure but similar effect can be obtained with other types of polysilicon thin film transistor, such as an inverse stagger structure.

In the manufacturing steps from 15(*a*) through 15(*k*), the maximum processing temperature is 600° C. Therefore, the substrate 51 can be made of a high heat resistant glass, such as a glass 1737 provided by Corning Inc (US).

By thus forming the polysilicon thin film transistor at or lower than 600° C, the insulation substrate can be made of a low-cost glass substrate with a large area. Consequently, there is realized a low-cost image display device 1 with a large display area.

Note that, in case of a liquid crystal display device, the image display device 1 further includes a transmitting electrode (for a transmissive LCD) or a reflection electrode (for a reflection LCD) via another interlayer insulation film.

As described, a shift register block according to the present invention includes: at least one system of a shift register constituted of a plurality of unit circuits in a form of cascade connection and outputting an input signal in response to a clock signal, the shift register sequentially outputting a selection signal from output-stages constituted of the unit circuits, wherein: the plurality of unit circuits are disposed with a unit circuit of a preceding output stage and a unit circuit of a following output stage being separated by a circuit different from the unit circuits.

Here, the different circuit may be a processing circuit which uses output of one of the unit circuits constituting the shift register, or unit circuits constituting a shift register of a different system.

In the foregoing arrangement, the shift register block is arranged so that each of adjacent unit circuits in a form of cascade connection for constituting a system of shift registers have therebetween different circuits not involved in operation of the shift register.

Adoption of such a layout of the shift register block in which the different circuits are distributed between the respective unit circuits allows further reduction of the required layout area in the vertical direction, compared to the conventional arrangement of a shift register block in which the different circuits are provided in parallel with the shift register in the vertical direction.

The different circuit may be a processing circuit which uses output of one of the unit circuits constituting the shift register, or a unit circuit constituting a shift register of a different system.

Particularly, in this structure, the unit circuits of different systems are linearly disposed by disposing unit circuits of one system between each of unit circuits of the other system.

Accordingly, in contrast to the case where the shift registers of different systems are disposed in parallel with each other in the vertical direction, it is possible to prevent variation of delay time of output signals between the shift registers of different systems due to difference of distance for supplying output signals.

The foregoing different circuit may be a processing circuit which uses output of one of the unit circuits constituting the shift register, a unit circuit constituting a shift register of a different system, and a processing circuit which uses output of one of the unit circuits constituting the shift register of the different system.

In this arrangement, the shift registers of different systems are linearly disposed, and besides, the processing circuits using outputs of the respective unit circuits constituting the shift register of different systems are further linearly disposed between the respective shift registers of different systems. Adoption of such a layout of the shift register block allows further reduction of the required layout area in the vertical direction, while also preventing variation of delay time of output signals between the shift registers of different systems.

Further, the shift register block according to the present invention is preferably arranged so that the shift register block includes signal paths for the shift registers of the respective systems, the signal path being provided separately for each of the shift registers of the respective systems on both sides of a circuit alignment constituted of the unit circuits of the shift registers of the respective systems.

The structure in which shift register of plural systems are linearly disposed, the signal lines for connecting the unit circuits of the respective systems intersect with each other, and each crossing point of such intersections has a parasitic capacitance. However, by providing the signal path separately for each of the shift registers of the respective systems on both sides of a circuit alignment constituted of the unit circuits of the shift registers of the respective systems, it is possible to prevent such a parasitic capacitance by reducing the number of crossing points of the signal lines, thus minimizing mutual influence of the parasitic capacitances.

Further, the increased number of crossing points causes an increase of contact area for connecting plural metal layers, thus enlarging the layout area. Accordingly, by reducing the number of crossing points, it is possible to effectively use the layout area both in the vertical direction and the horizontal direction, thus further reducing the frame area.

As described, a signal line driving circuit according to the present invention comprises: a shift register block for sequentially outputting a selection signal, so as to drive a plurality of signal lines, wherein the shift register block comprises the foregoing shift register block of the present invention.

As explained above, the shift register block according to the present invention allows effective reduction of the required layout area in the vertical direction, while also preventing variation of delay time of output signals between the shift registers of different systems when including plural systems of shift registers.

Accordingly, by using a signal line driving circuit including such a shift register block for a scanning signal line driving circuit and/or a data signal line driving circuit of a display device, it is possible to effectively reduce the frame area around the display section, while ensuring display quality.

Further, as described, a data signal line driving circuit according to the present invention comprises: a sampling section for driving a plurality of data signal lines by sampling image data from an image signal according to a selection signal sequentially outputted from a shift register block so as to transfer the image data to the data signal lines, wherein the shift register block comprises the foregoing shift register block of the present invention.

As explained above, the shift register block according to the present invention allows effective reduction of the required layout area in the vertical direction, while also preventing variation of delay time of output signals between the shift registers of different systems when including plural systems of shift registers.

Accordingly, by mounting a data signal line driving circuit including such a shift register block, it is possible to effectively reduce the frame area around the display section, while ensuring display quality.

Particularly, the effect of the foregoing shift register block becomes significant when used with a data signal line driving circuit having a structure for carrying out multiple-phase driving in which image signals are divided according to an alignment order of the data signal lines, and the sampling section carries out sampling at the same timing for the divided image signals. This is because, the shift register block in this structure can offer wider provision pitch of the unit circuits, which is restricted by such as the pixel pitch, thus sufficiently obtain the area in horizontal direction.

A data signal line driving circuit including the shift register block according to the present invention may be arranged so that, when the image signal is an analog signal, the circuit different from the unit circuits is made up of one of a waveform shaping circuit, a buffer circuit, a sampling circuit, and a level shifter circuit, which use outputs of the unit circuits constituting the shift register. These circuits are required for carrying out sampling of analog image signals transmitted to the image signal lines.

Further, a data signal line driving circuit including the shift register block according to the present invention may be arranged so that, when the image signal is a digital signal, the circuit different from the unit circuits is made up of one of a data latch circuit, a digital/analog conversion circuit, an output circuit, a level shifter circuit, and a decoder circuit, which use outputs of the unit circuits constituting the shift register. These circuits are required for carrying out sampling of digital image signals transmitted to the image signal lines.

Note that, in a layout in which the processing circuits are disposed between unit circuits constituting a shift register, it is not necessary to dispose all of the processing circuits within the vertical length of the unit circuit, since the size of the data signal line driving circuit in the vertical direction can be reduced by disposing a part of the processing circuits to be adjacent to the unit circuits in the horizontal direction.

As described, a display device according to the present invention comprises a plurality of data signal lines; a plurality of scanning signal lines intersecting with the data signal lines; pixels provided for each pair of the data signal lines and the scanning signal lines; a scanning signal line driving circuit for driving the scanning signal lines; and a data signal line driving circuit comprising a sampling section for driving a plurality of data signal lines by sampling image data from an image signal according to a selection signal sequentially outputted from a shift register block so as to transfer the image data to the data signal lines, wherein the data signal line driving circuit is the foregoing data signal line driving circuit of the present invention.

As explained above, the shift register block according to the present invention allows effective reduction of the required layout area in the vertical direction, while also preventing variation of delay time of output signals between the shift registers of different systems when including plural systems of shift registers.

Accordingly, by mounting a signal line driving circuit including such a shift register block in a display device, it is possible to effectively reduce the frame area around the display section, while ensuring display quality.

Further, if there are any demands for cost reduction, it is preferable in addition to the foregoing arrangement that the data signal line driving circuit and the scanning signal line driving circuit are formed on a substrate on which the pixels are formed.

With this arrangement, since the pixels, the data signal line driving circuit and the scanning signal line driving circuit are formed on the same substrate, cost of manufacturing and mounting can be reduced compared with the case of individually forming them on separate substrates and connecting the separate substrates to one another.

Further, in addition to the foregoing arrangement, the pixels, the data signal line driving circuit, and the scanning signal line driving circuit may include active elements, respectively, each of which is made of a polysilicon thin film transistor.

With this arrangement, it is possible to use a larger substrate than the case where the active elements are made of monocrystal silicon transistor. Thus, there is realized a display device causing low power consumption and having a large screen, at low cost.

Further, in addition to the foregoing arrangement, the active elements may be formed on a glass substrate at a process temperature of not more than 600° C. with this arrangement, the active elements can be formed on a glass substrate since the elements are formed at a process temperature of not more than 600° C. Thus, there is realized a display device causing low power consumption and having a large screen, at low cost.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A shift register block comprising:

at least one system of a first shift register comprising a plurality of spaced-apart, cascade-connected first unit circuits and outputting an input signal in response to a clock signal, the first shift register sequentially outputting a selection signal from output-stages comprised of the first unit circuits, wherein:

a first circuit which is not one of the first unit circuits of the first shift register is disposed in the physical space between a first unit circuit of a preceding output stage and a first unit circuit of a following output stage;

the first circuit comprises (i) a processing circuit which uses output of one of the first unit circuits, (ii) a second unit circuit for a second shift register of a system different from a system of the first shift register, and (iii) a processing circuit which uses output of the second unit circuit of the second shift register; and signal paths for the first and second shift registers are provided separately for each of the first and second shift registers on respective sides of a circuit alignment of the first and second unit circuits of the first and second shift registers.

2. The shift register block as set forth in claim 1, wherein: the first and second unit circuits are flip-flop circuits.

3. The shift register block as set forth in claim 1, wherein the first unit circuits for the first shift register are disposed linearly with the first circuit.

4. A signal line driving circuit, comprising:

a shift register block for sequentially outputting a selection signal, so as to drive a plurality of signal lines, wherein:

the shift register block comprises:

at least one system of a first shift register comprising a plurality of spaced-apart, cascade-connected first unit circuits and outputting an input signal in response to a clock signal, the first shift register sequentially outputting a selection signal from output-stages comprised of the first unit circuits, wherein a first circuit which is not one of the first unit circuits of the first shift register is disposed in the physical space between a first unit circuit of a preceding output stage and a first unit circuit of a following output stage; the first circuit comprises (i) a processing circuit which uses output of one of the first unit circuits, (ii) a second unit circuit for a second shift register of a system different from a system of the first shift register, and (iii) a processing circuit which uses output of the second unit circuit of the second shift register; and signal paths for the first and second shift registers are provided separately for each of the first and second shift registers on respective sides of a circuit alignment of the first and second unit circuits of the first and second shift registers.

5. A data signal line driving circuit comprising:

a sampling section for driving a plurality of data signal lines by sampling image data from an image signal according to a selection signal sequentially outputted from a shift register block so as to transfer the image data to the data signal lines, wherein:

the shift register block comprises:

at least one system of a first shift register comprising a plurality of spaced-apart, cascade-connected first unit circuits and outputting an input signal in response to a clock signal, the first shift register sequentially outputting a selection signal from output-stages comprised of the first unit circuits, wherein a first circuit which is not one of the first unit circuits of the first shift register is disposed in the physical space between a first unit circuit of a preceding output stage and a first unit circuit of a following output stage; the first circuit comprises (i) a processing circuit which uses output of one of the first unit circuits, (ii) a second unit circuit for a second shift register of a system different from a system of the first shift register, and (iii) a processing circuit which uses output of the second unit circuit of the second shift register; and signal paths for the first and second shift registers are provided separately for each of the first and second shift registers on respective sides of a circuit alignment of the first and second unit circuits of the first and second shift registers.

6. The data signal line driving circuit as set forth in claim 5, wherein:

the sampling section carries out sampling of image data of divided image signals which are generated by dividing the image signal according to an alignment order of the data signal lines, the sampling section simultaneously carrying out sampling of the image data of the divided image signals.

7. The data signal line driving circuit as set forth in claim 5, wherein:

the image signal is an analog signal.

8. The data signal line driving circuit as set forth in claim 5, wherein:

the image signal is a digital signal.

9. A display device, comprising:

a plurality of data signal lines;

a plurality of scanning signal lines intersecting with the data signal lines;

pixels provided for each pair of the data signal lines and the scanning signal lines;

a scanning signal line driving circuit for driving the scanning signal lines; and a data signal line driving circuit comprising a sampling section for driving a plurality of data signal lines by sampling image data from an image signal according to a selection signal sequentially outputted from a shift register block so as to transfer the image data to the data signal lines, wherein:

the shift register block of the data signal line driving circuit comprises:

at least one system of a first shift register comprising a plurality of spaced-apart, cascade-connected first unit circuits and outputting an input signal in response to a clock signal, the first shift register sequentially outputting a selection signal from output-stages comprised of the first unit circuits, wherein a first circuit which is not one of the first unit circuits of the first shift register is disposed in the physical space between a first unit circuit of a preceding output stage and a first unit circuit of a following output stage; the first circuit comprises (i) a processing circuit which uses output of one of the first unit circuits, (ii) a second unit circuit for a second shift register of a system different from a system of the first shift register, and (iii) a processing circuit which uses output of the second unit circuit of the second shift register; and signal paths for the first and second shift registers are provided separately for each of the first and second shift registers on respective sides of a circuit alignment of the first and second unit circuits of the first and second shift registers.

10. The display device as set forth in claim 9, wherein:

the data signal line driving circuit and the scanning signal line driving circuit are formed on a substrate on which the pixels are formed.

11. The display device as set forth in claim 10, wherein:

the pixels, the data signal line driving circuit, and the scanning signal line driving circuit include active elements, respectively, each of which is made of a polysilicon thin film transistor.

12. The display device as set forth in claim 11, wherein:

the active elements are formed on a glass substrate at a process temperature of not more than 600° C.

13. A shift register block comprising:

a first shift register comprising a plurality of cascade-connected first unit circuits for sequentially propagating an input signal therethrough in response to a clock signal, the first unit circuits of the first shift register being linearly disposed so that physical spaces are provided between each adjacent pair of first unit circuits; wherein a first circuit which is not one of the first unit circuits of the first shift register is disposed in the physical space between a first unit circuit of a preceding output stage and a first unit circuit of a following output stage, the first circuit comprises (i) a processing circuit which uses output of one of the first unit circuits, (ii) a second unit circuit for a second shift register of a system different from a system of the first shift register, and (iii) a processing circuit which uses output of the second unit circuit of the second shift register, and signal paths for the first and second shift registers are provided separately for each of the first and second shift registers on respective sides of a circuit alignment of the first and second unit circuits of the first and second shift registers.

* * * * *